US005238788A

United States Patent [19]

Kajiwara et al.

[11] Patent Number: 5,238,788

[45] Date of Patent: Aug. 24, 1993

[54] METHOD FOR FORMING A DYE IMAGE

[75] Inventors: Makoto Kajiwara; Takashi Kadowaki, Odawara, Japan

[73] Assignee: Konica Corporation, Tokyo, Japan

[21] Appl. No.: 820,331

[22] Filed: Jan. 13, 1992

[30] Foreign Application Priority Data

Jan. 18, 1991 [JP] Japan ..... 3-19279

[51] Int. Cl.[5] ..... G03C 7/00

[52] U.S. Cl. ..... 430/357; 430/393; 430/430; 430/525; 430/947; 430/950

[58] Field of Search ..... 430/525, 947, 950, 357, 430/393, 430

[56] References Cited

U.S. PATENT DOCUMENTS 4,980,274 12/1990 Tai et al. ..... 430/950
5,043,253 8/1991 Ishikawa ..... 430/393
5,100,770 3/1992 Ashida ..... 430/525

FOREIGN PATENT DOCUMENTS 388908 9/1990 European Pat. Off. .
466372 1/1992 European Pat. Off. .
2138964 10/1984 United Kingdom .

*Primary Examiner*—Hoa Van Le
*Attorney, Agent, or Firm*—Jordan B. Bierman

[57] ABSTRACT

There is disclosed a method for forming a dye image which comprises a step of processing, with a color developing solution, a photo-sensitive silver halide photographic material comprising a support having thereon a silver halide emulsion layer. The method is characterized in that said silver halide emulsion layer comprises silver halide grains having a silver chloride content of not less than 90 mol. %; said photosensitive silver halide photographic material comprises a white pigment in an amount of not less than 3.5 g per $m^2$ of said photographic material; and said photosensitive silver halide photographic material is, after being processed with the color developing solution, processed with a bleaching solution (BL-1) and subsequently with a fixing solution.

9 Claims, No Drawings

METHOD FOR FORMING A DYE IMAGE

FIELD OF THE INVENTION

The present invention relates to a method for producing a dye image from a photo-sensitive silver halide photographic material and, more specifically, it relates to a method of producing a dye image having improved color reproduction and sharpness and improved film quality after development process.

BACKGROUND OF THE INVENTION

Although photo-sensitive silver halide photographic material is well known for its capability of giving especially excellent image quality and sensitivity, there is still a demand for further improvement in its image quality.

Among important factors relating to the image quality, there can be mentioned two, that is to say, color reproducibility, which is an ability to what extent the colors contained in the original can faithfully and vividly be reproduced, and sharpness, which gives a great effect on vividness and impression of three-dimensional depth of the produced image, to be essential.

For the improvement of the color reproducibility, many other requirements must be satisfied and, among these requirements, spectral sensitivity in the case of the photo-sensitive materials for printing use is important.

In this respect, in the case of high silver chloride-containing type color paper, silver chloride is especially advantageous for the reason that it has no effective spectral absorption in the visible spectral region and, for this reason, the inherent sensitivity does not injure distinguishability with respect to red-sensitivity, green-sensitivity and blue-sensitivity, i.e., no color contamination is brought about.

On the other hand, in order to improve sharpness, various attempts have been made, and it is known in the art that a technique of incorporating a white pigment into photo-sensitive printing materials for image appreciation works for the improvement of the image sharpness.

Since it is known that increasing incorporation of a white pigment improves image sharpness. In general, various technical attempts to incorporate this at a higher content in the photo-sensitive materials have been made in the art.

For example, Japanese Patent Publications Open to Public Inspection (herein after referred to as "Japanese Patent O.P.I. Publication") Nos. 55-113039(1980), 55-113040(1980) and 57-35855(1982) disclose a technique of modifying a white pigment by the use of certain kinds of amine compounds, -diketone chelating compounds and polyhydric alcohols to improve dispersibility:

Further, Japanese Patent O.P.I. Publication Nos. 57-151942(1982), 58-111030(1983) and 58-7630(1983) disclose a technique of incorporating the white pigment at a higher amount by treating the surface of the pigment with certain kinds of alkyl titanate, and organopolysiloxane.

On the other hand, manufacturers of the photographic materials have been requested by their users to provide these materials at lower cost.

For this reason, improved productivity of the materials has been a long-felt demand in the relevant field of the art.

For the purpose of improving efficiency of the productivity of the photographic materials, various attempts have been made by the manufacturer. Among these attempts, enhancement of coating speed, by which photographic layers including a silver halide emulsion layers are provided on a support and which can directly lead to the improvement of productivity of the materials, has always been a demand assigned on the manufacturer.

However, coating the photographic layer at very high speed uniformly and without causing any defects is not a very easy task for the manufacture. For with increasing the coating speed, troubles such as due to streaking or lack of uniformity become more likely to take place, which hinders speeding up of the coating rate.

Recently, demand for large size print has become larger and even a tiny coating defect, which had not become a subject for trouble, has become a matter of concern in a large size photo-printing paper because it is conspicuous.

It has been known in the art that these coating characteristics are largely dependent upon the component of the silver halide emulsion coating liquid or quality of the support upon which the emulsion is to be coated. Further, it has also been known in the art that non-uniformity is likely to take place after developing process in a photographic material in which high chloride-containing silver halide emulsion is employed. In view of the state of the art mentioned above, overall improvement has been requested.

SUMMARY OF THE INVENTION

Thus the assignment to be solved by the invention is to provide a method for producing an image which is excellent in its color reproduction, image sharpness, and having an excellent and stable film quality of the photographic layers (hereinafter referred to as "film quality") after they are coated on a support and then processed.

The present invention specifically relates to a method of forming a dye image with a color developing solution on a silver halide photographic photo-sensitive material, which comprises, on a support, at least one silver halide emulsion layer, the method being characterized in that at least one silver halide emulsion layer contains, as a photo-sensitive silver halide, silver halide grains having silver chloride content of not less than 90 mol. %; that the silver halide photographic photo-sensitive material comprises a white pigment in an amount of not less than 3.5 g/m$^2$; and that the silver halide photographic photo-sensitive material is, after being processed with a color developing solution, processed with a bleaching solution and subsequently with a fixing solution.

Further, the present invention relates to a method of forming a dye image on a silver halide photographic photo-sensitive material containing a magenta dye-forming coupler represented by the following general formula [M-1] in at least one silver halide emulsion layer thereof:

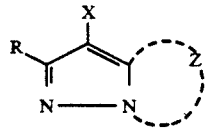

Formula [M-1]

wherein in the formula, Z represents a group of non-metal atoms necessary to complete a nitrogen-containing heterocyclic ring which may have a substituent; X represents a hydrogen atom or a group which is capable of being released from the compound [M-1] upon reaction with an oxidation product of a color developing agent and R represents a hydrogen atom or a substituent.

As a white pigment used in the present invention, inorganic and/or organic white pigments may be used. The preferable ones are, inorganic white pigments, such as, for example, sulfates of alkaline earth metals including barium sulfate; carbonates of alkaline earth metals including calcium carbonate; fine powder of silicate; silica of a synthesized silicate; calcium silicate; alumina, hydrate of alumina, titanium oxide, zinc oxide, talc, and clay, etc.. Among these compounds, barium sulfate, calcium carbonate, and titanium oxide are more preferable and, most advantageously, barium sulfate and titanium oxide may be used. The titanium oxide may be either of an anatase type or of a rutile type. Moreover, the one whose surface is coated with a metalic oxide such as a hydrated alumina, hydrated ferrite, etc. may also be used.

In order to incorporate the white pigment into the photo-sensitive material, various methods may be applied.

For example, it may be incorporated in the support, and in this case, it may be incorporated either into a coating layer to be provided on the substratum of the support or into the substratum itself.

As an example of the former, color photographic papers which are widely used, can be mentioned.

The support of a color photographic paper usually comprises a raw paper consisting mainly of a natural pulp, etc. and alpha-olefin polymer covering the raw paper. The white pigment is incorporated into the alpha-olfin polymer coating layer. In this case, it is advantageous for the white pigment to be incorporated in a proportion of from 12 to 50% by weight with respect to the coating layer.

As the example of the latter, the white pigment is incorporated into a plastic film obtained by constituting the support.

As a polymer to form these plastic films, for example, a homopolymer or its copolymer such as polyester (for example, polyethyleneterephthalate), a vinyl alcohol, a vinyl chloride, a vinyl fluoride and a vinyl acetate; and a homopolymer or its copolymer such as a cellulose acetate, an acrylonitrile, a methacrylo nitrile, an alkyl acrylate, an alkyl methacrylate, an alkyl vinyl ether, and polyamide, etc. can be mentioned. Among the above-mentioned polymers, polyester is particularly advantageous.

In this case, it is preferable for the white pigment to be incorporated in the ratio of from 5 to 50% by weight of the support.

As another method for incorporation of the white pigment, either at the same time, or before or after silver halide emulsion layers are provided on the support, a white pigment-containing layer, in which the white pigment is dispersed in a binder, may be provided on the support.

In this case, the support may or may not contain the white pigment.

With regard to coating amount of the white pigment, not less than 3.5 g/m$^2$ can provide the effect of the present invention, and, more advantageously, 4 g/m$^2$ is usually preferable.

Although there is no particular upper limitation, use of the white pigment in an amount of not less than 15 g/m$^2$ would be less advantageous in view of the increase of effect and not preferable in view of the production cost.

The silver halide which can advantageously be employed in the present invention contains silver chloride at a content of not less than 90 mol. %. More advantageously, the silver halide to be used in the present invention contains silver bromide in an amount of not more than 10 mol. % and silver iodide in an amount of not more than 0.5 mol. %. According to one of the most preferable embodiments of the present invention, the silver halide is a silver bromochloride of which silver bromide content is within a range from 0.1 to 1 mol. %.

The silver halide particles of the present invention may be used independently or in combination with other silver halide grains having different composition. Also, they may be mixed with silver halide particles having silver chloride content of less than 10 mol. %.

Further in the silver halide emulsion layer containing silver halide particles having silverchloride content of not less than 90 mol. %, proportion of such silver halide particles having the silver chloride content of not less than 90 mol. % to the total silver halide particles in the emulsion layer is normally 60% by weight or more and, more preferably, more than 80% by weight or more.

The composition of the silver halide particle used in the present invention may either be uniform from the center to outer surface thereof, or be different between the center of the particle and the outer portion thereof. In the case of the latter, the composition from the inside to the outer portion of the particle may change either continuously or stepwise.

Though there is no specific limitation in the particle size of the silver halide particles used in the present invention, it is advantageous for the particle size to fall within a range between 0.2 and 1.6 μm and more preferably between 0.25 and 1.2 μm from the view point of other photographic properties such as rapid processing and sensitivity. The measurement of the particle size of the silver halide particles mentioned above may be made according to various manners which are conventionally known and employed in the art.

Typical examples of the method for the measurement are described in "Particle size Measurement" by R. P. Loveland; A.S.T.M. Simposium on Light Microscopy, pp 94–122(1955) and Mees & James: "The Theory of the Photographic Process", 3rd edition, published by McMillan (in 1966).

The particle size may be measured by using a projected area of a particle or an approximate value of the particle diameter.

In the case where the shapes of the particles are substantially uniform, particle size distribution can be expressed with considerable precision in terms of a diameter or a projected area.

Distribution of size of the silver halide particles used for the present invention may be either so-called polydispersion or mono-dispersion. However, mono-dispersed silver halide particles having a coefficient of variation of 0.22 or less are preferable and, those having that of 0.15 or less are more preferable.

In this case, the "coefficient of variation" is one expressing degree of width of the particle size distribution, and this is defined by the following formulae:

$$\text{Coefficient of Variation} = \frac{S}{\bar{r}}$$

$$\text{Standard deviation of size-distribution: } S = \sqrt{\frac{\Sigma(\bar{r} - ri)^2 ni}{\Sigma ni}}$$

$$\text{Average particle-size: } \bar{r} = \frac{\Sigma niri}{\Sigma ni}$$

In the above formulae, ri represents the size of individual particles and ni represents the number of particles. The term, "particle size", herein expressed represents a diameter when the particles have a spherical shape, and it represents a diameter of a circle converted from the equivalent projected image of the particle when the particle takes a shape other than a cube or a sphere.

The silver halide particles used in the silver halide emulsion of the invention may be manufactured according to either an acidic process, a neutral process or an ammoniacal process. The silver halide particles may be grown either continuously or stepwise subsequent to the formation of seed crystal particles.

Manner for manufacturing the seed crystal particles and that for growing the same, may either be the same or different.

With regard to a mixing method of a soluble silver salt solution with a soluble halide solution, any conventionally known method such as normal precipitation method reverse precipitation method, simultaneous mixing method or any combination thereof may be employed. Among these methods, however, a simultaneous mixing method can advantageously be employed. Moreover, as one of the simultaneous mixing methods, so-called "pAg- Controlled Double Jet Method" as disclosed in Japanese Patent O.P.I. Publication No. 54-48521(1979) may also be applied. Furthermore, whenever necessary, an adequate solvent of silver halide such as thioether may be used.

In the present invention, silver halide particles having any crystal habit can optionally be used. One of the advantageous examples of the present invention is a crystal of a cubic form, which has (100) surface as the crystal surface.

Further, crystals of an octahedron, a tetradecahedron or a dodecahedron manufactured according to the manner as disclosed in U.S. Pat. Nos. 4,183,756 and 4,225,666; Japanese Patent O.P.I. Publications Nos. 55-26589(1980) and 55-42737, Japanese Patent Publication for Opposition No. 55-42737(1980) or Journal of Photographic Science 21,39(1973) can also be used.

Still more, crystals having a twin plane may be used.

The silver halide crystals used in the present invention may consist of those having the same and single crystal habit or of those in which a various kinds of crystals having different crystal habits are contained.

The silver halide particles used in the silver halide emulsion of the present invention may be incorporated inside or onto the surface thereof with a metal ion using, for example, a cadmium salt, a zinc salt, a lead salt, a thallium salt, an iridium salt or a complex salt thereof, a rhodium salt or a complex salt thereof, an iron salt or a complex salt thereof, etc., during the period of the formation of crystal particle and/or the growth thereof.

Also, they may be conferred with a reduction sensitizing nuclei by being placed in a reducing atmosphere.

From a silver halide emulsion containing the silver halide crystal particles used in the present invention, which is herein referred to as "the emulsion of the invention", any unnecessary soluble salt may be removed after completion of growth of the silver halide crystal particles. Or, it may be left in the emulsion. Removal of such salt can be carried out according to a manner disclosed, for example, in the Research Disclosure No. 17643.

The silver halide crystal particles used in the emulsion of the invention may be of a kind wherein a latent image is formed mainly either on the surface of the crystal particle or inside thereof. In the present invention, the former type is more advantageous.

The emulsion of the invention may be chemically sensitized according to any of conventionally known manners. That is, the sulfur sensitization, where a compound containing sulfur capable of reacting on a silver ion or an active gelatin is used; selenium sensitization using a selenium compound; reduction sensitization using a reducing substance; and a noble metal sensitization using gold or other noble metal compounds may be applied either singly or in combination.

As a chemical sensitizer, for example, a chalcogen sensitizer may be used.

The chalcogen sensitizer is a general term for sulfur sensitizer, selenium sensitizer and tellurium sensitizer, and for photographic purpose, the sulfur sensitizer and the selenium sensitizer are advantageous.

Typical examples of sulfur sensitizer include a thiosulfate, an aryl thiocarbazide, thiourea, an allyl isothiocyanate, cystine, p-toluene thiosulfonate, and rhodanine, etc.. Further, those sulfur sensitizer disclosed in U.S. Pat. Nos. 1,574,944; 2,410,689; 2,278,947; 2,728,668; 3,501,313 and 3,656,955; DT-OS 1,422,869; Japanese Patent O.P.I. Publication Nos. 56-24937(1981), and 55-45016(1980) may also be used.

The amount of the sulfur sensitizer as mentioned above may vary to a considerable degree depending upon various conditions such as pH and temperature of the emulsion, average particle size of the silver halide contained in the emulsion, etc.. As a guide, from $10^{-7}$ to $10^{-1}$ mol per mol of silver halide may be advantageous.

Selenium sensitizer in place of the sulfur sensitizer may also be used in the present invention. As examples for the selenium sensitizer, for example, aliphatic selenocyanates such as an allyl iso selenocyanate, seleno-ureas, seleno-ketones, seleno-amides, seleno-carbonates and esters thereof, seleno-phosphates, and selenides such as di-ethyl selenide or diethyl di-selenide, etc. may be mentioned. These exemplified compounds are disclosed in, for example, U.S. Pat. Nos. 1,574,944; 1,602,592 and 1,623,499.

Further the silver halide emulsion of the invention may be sensitized by means of reduction sensitization. There is no specific limitation in the reducing compound to be used. For example, stannous chloride, thiourea dioxide, hydrazine, and polyamine, etc. may be mentioned.

Furthermore, a compound of noble metals other than gold, for example, an iridium compound may also be used in combination.

The silver halide particles used in the present invention preferably contains a gold compound.

As a gold compound, which can be used advantageously for the present invention, various kinds of them in which oxidation number is either mono-valent or tri-valent can be used. Typical examples of the gold compounds include auric chloride, potassium chloro aurate, auric trichloride, potassium auric thiocyanate, potassium iodoaurate, tetra-cyano auric azide, anmmonium aurothiocyanate, pyridyl trichlorogold, gold sulfide, and gold selenide, etc.

The gold compounds mentioned above may be used so as to function as a sensitizing agent, or they may be used so that they substantially do not work as the sensitizer.

The amount of the gold compound may vary depending upon variety of required conditions. However, $10^{-8}$ to $10^{-1}$ mol, and, more preferably, $10^{-7}$ to $10^{-2}$ mol per mol of silver halide is advantageous as a guide.

In this case, the compound may be added at any time either during formation of the silver halide crystal particles, during physical ripening or chemical ripening step, or after completion of the chemical ripening step.

The silver halide emulsion of the present invention can be spectrally sensitized so that it is sensitive to a specific desired spectral region of visible light by using sensitizing dyes, which are conventionally known and used in the photographic field. The sensitizing dye may be used either singly or in combination of two or more kinds.

Together with the sensitizing dye, so-called a hypersensitizing dye or agent, which itself does not work as a spectral sensitizer, or which does not substantially absorb light in the visible spectral range, but has a function to emphasizing the sensitizing effects of the sensitizing dye or agent, may be incorporated in the emulsion.

Color developing agent to be contained in a color developing solution used in the present invention includes variety of compounds which are conventionally known in the relevant fields and used widely in various color developing processes. Typically, these compounds include aminophenol and derivatives of p-phenylene diamine derivatives. These compounds are usually used in the form of a hydrochloride or sulfate to be more stable than in the free state. These compounds are usually used in the color developing solution at a concentration ranging from 0.1 g to 30 g and, more preferably 1 g to 15 g per liter of the solution.

Examples of the aminophenol-type developing agents include, o-aminophenol, p-aminophenol, 5-amino-2-hydroxy toluene, 2-amino-3-hydroxy toluene, and 2-hydroxy-3-amino-1,4-dimethyl benzene, etc..

Particularly advantageous aromatic primary amino color developing agents are N,N-dialkyl-p-pheylenediamine compounds, whose alkyl group and phenyl group may be substituted by any optional substituent. Among these compounds, particularly preferable compounds include, for example, N,N-diethyl-p-phenylene- diamine hydrochloride, N-methyl-p-phenylene-diamine hydrochloride, N,N-dimethyl-p-phenylene-diamine hydrochloride, 2-amino-5-(N-ethyl-N-dodecylamino)toluene, N-ethyl-N-$\beta$-methanesulfonamideethyl -3-methyl-4-amino aniline sulphate, N-ethyl-N-$\beta$-hydroxyethyl amino aniline, 4-amino-3-methyl-N,N-diethyl aniline, 4-amino-N-(2-methoxyethyl)-N-ethyl-3-methylaniline-p-toluenesulfonate, etc. may be mentioned.

To the developing solution employed for processing the silver halide photographic light-sensitive material of the present invention, various kinds of other additives, which are conventionally known and used in the photographic art, may be added in addition to the color developing compounds mentioned above. For example, an alkaline agent such as sodium hydroxide or potassium carbonate; an alkali metal sulfite; an alkali metal bisulfite; an alkali metal thiocyanide; an alkali metal halide, benzyl alcohol, a water softening agent and a thickener, etc. may optionally be used.

The temperature of the developing solution, is not lower than 15° C., generally in the range between 20° C. and 50° C. and, most advantageously, in the range between 30° C. and 45° C.

The pH value of the solution is usually not less than 7 and, most popularly, in the range between 10 and 13.

Although there is no specific limitation regarding a period of time for developing process, three minutes or less may be preferable. The effect of the present invention is distinctive in a rapid process. The effect of the present invention is especially great when the developing time is 90 seconds or less, particularly 30 seconds or less.

The silver halide photographic light-sensitive material used in the present invention may contain the above-mentioned color developing agent, as the compound per se or in the form of a precursor thereof, in a hydrophilic colloidal layer constituting the photographic material, which is processed with an alkaline activating liquid.

The color developing agent precursor is a compound which is capable of producing a color developing agent under alkaline conditions. For example, a Schiff-base type precursor, a multi-valent metal ion complex precursor, a phthalic acid imide derivative precursor, a phosphoric acid amide derivative type precursor, a sugar amine reaction product type precursor and an urethane type precursor, etc. are known. These aromatic primary amino color developing agent precursors are disclosed, for example, in U.S. Pat. Nos. 3,342,599; 2,507,114; 2,695,234 and 3,719492; British Patent No. 803,784; Japanese Patent O.P.I. Publications Nos. 53-185628(1978), 54-79035(1979) and Research Disclosure Nos. 15159, 12146, 13924, etc.

These color developing agents or the precursors thereof are required to be added to the photographic material in an amount necessary to obtain enough color density when subjected to the activation process. The amount of addition may vary greatly depending on the kind of the photographic materials. However, they are used usually in a range between 0.1 and 5 mols and, more preferably between 0.5 and 3 mols per unit mol of silver halide.

These color developing agents or the precursors thereof may be used either singly or in combination.

For incorporating the above-mentioned color developing agents or the precursors thereof into the photographic material, there are variety of manners; i.e., a method to add them after dissolving the compound with an adequate solvent such as water, methanol, ethanol, acetone, etc. or a method to incorporate the compound in the form of an emulsion using a high boiling organic solvent such as dibutyl phthalate, dioctyl phthalate, tricresyl phosphate, etc.; or the manner for adding as disclosed in the Research Disclosure No. 14850, wherein the compound is incorporated after impregnating it in a latex polymer.

The silver halide photographic light-sensitive material of the present invention is, after color development process, subjected to a bleaching and, subsequently, a fixing process.

In the present invention, as a bleaching agent used in the bleach solution, a ferric complex compound represented by the following general formula [A] or formula [B] is preferably used;

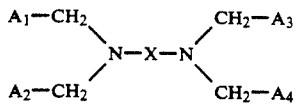

Formula [A]

[wherein $A_1$, $A_2$, $A_3$ and $A_4$ are independently selected from the group consisting of a —CH20H group, a —COOM group and —$PO_3M_1M_2$ group, in which M, $M_1$ and $M_2$ are independently selected from the group consisting of a hydrogen atom, an alkali metal atom and an ammonium group and X represents a substituted or unsubstituted alkylene group having three to six carbon atoms]

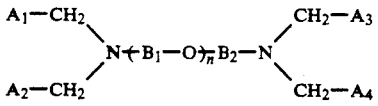

Formula [B]

[wherein the formula, $A_1$, $A_2$, $A_3$ and $A_4$ are independently selected from the same groups as $A_1$, $A_2$, $A_3$ and $A_4$ as defined in General Formula [A]; n is an integer of from one to eight; $B_1$ and $B_2$ independently represent a substituted or unsubstituted alkylene group having two to five cabon atoms]

In the following exemplified compounds which are advantageously used in the present invention are given.

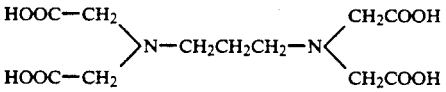

(A-1)

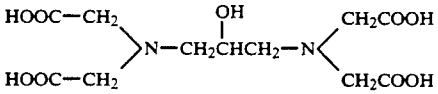

(A-2)

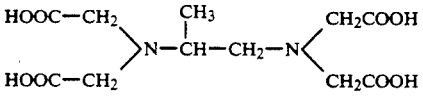

(A-3)

-continued

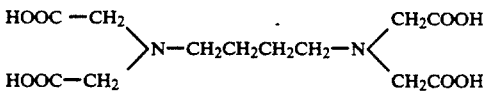

(A-4)

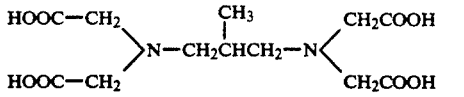

(A-5)

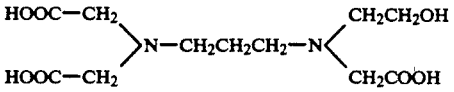

(A-6)

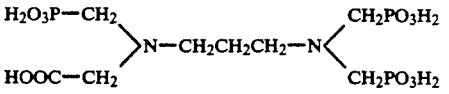

(A-7)

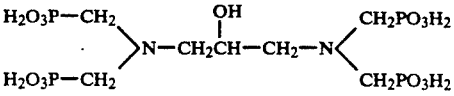

(A-8)

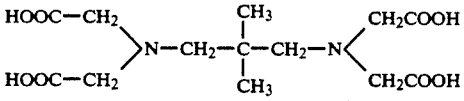

(A-9)

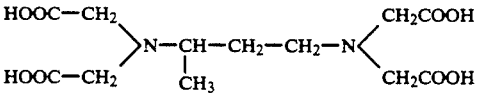

(A-10)

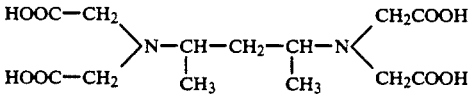

(A-11)

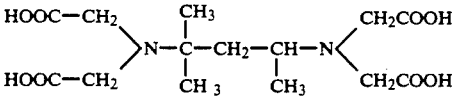

(A-12)

As a ferric complex salt compound of the exemplified compounds (A-1) through (A-12), there may be mentioned a sodium salt, a potassium salt and an ammonium salt, and among these salts, potassium salt and ammonium salt can be used advantageously.

Next exemplified compounds represented by the General formula [B] are given below:.

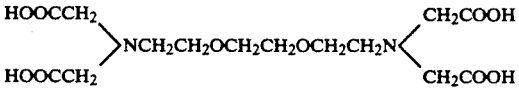

(B-1)

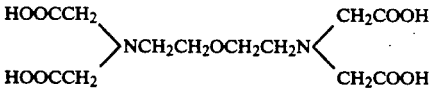

(B-2)

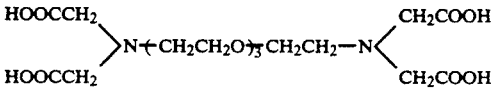

(B-3)

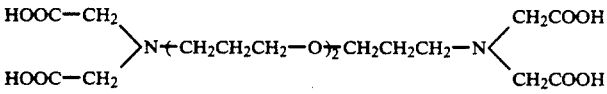

(B-4)

-continued

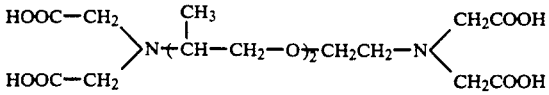

(B-5)

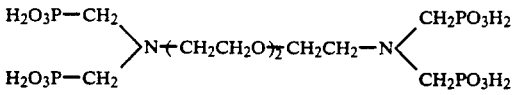

(B-6)

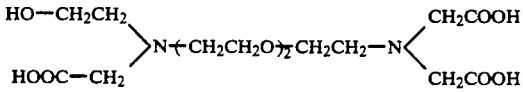

(B-7)

As a ferric complex salt compound of the exemplified compounds (B-1) through (B-7), either a sodium salt, a potassium salt or an ammonium salt thereof may optionally be used.

Among these exemplified compounds given above, (B-1), (B-2) and (B-7) are particularly advantageous.

Organic acid ferric complex salt compound of the compounds represented by formula [A] or [B] is preferably added to a bleaching solution in a quantity of not less than 0.1 mol and, more preferably, 0.2 mol per one liter of the bleaching solution.

According to one of the most advantageous embodiments of the present invention, the bleaching solution contains the compound in a quantity between 0.2 and 1.5 mols/liter.

In the bleaching solution, following bleaching agents may optionally be used together with the compound of the formulae [A] or [B] given above in the form of a ferric complex salt.

[A'-1] Ethylene diamine tetraacetic acid
[A'-2] Trans-1,2-cyclohexane diamine tetracetic acid
[A'-3] Dihydroxyethyl glycinic acid
[A'-4] Ethylenediaminetetrakis-methylene phosphonic acid
[A'-5] Nitriro trismethylene phosphonic acid
[A'-6] Diethylene triamine pentakismethylene phosphonic acid
[A'-7] Diethylene triamine pentaacetic acid
[A'-8] Ethylene diamine di-orthohydroxyphenyl acetic acid
[A'-9] Hydroxyethyl ethylenediamine triacetic acid
[A'-10] Ethylene diamine di-propionic acid
[A'-11] Ethylene diamine diacetic acid
[A'-12] Hydroxyethylimino diacetic acid
[A'-13] Nitriro triacetic acid
[A'-14] Nitriro tripropionic acid
[A'-15] Triethylene tetramine hexaacetic acid
[A'-16] Ethylene diamine tetra propionic acid The organic acid iron (III) complex salt may be used either in the form of a complex salt or by forming an iron (III) complex salt by using in a solution an iron (III) salt such as iron (III) sulfate, iron (III) acetate, ferric chloride, iron (III) sulfate ammonium, iron (III) phosphate, etc. with an aminopoly-carboxylic acid.

In the case where the compound is used in the form of a complex salt. It is either possible to use only one kind of complex salt singly or two or more kinds of complex salts in combination.

Further in the case where a complex salt is formed in a solution using an iron (III) salt and an amino polycarboxylic acid, either a single kind of ferric salt or two or more of ferric salts in combination may be used. Still further, regarding polyaminocarboxylic acid, there may be either case where a single kind of polyaminocarboxylic acid singly, or two or more kinds of polyaminocaboxylic acids in combination. Moreover in either case, the polyaminocarboxylic acid may be used in excess of an amount needed to form an iron (III) complex salt.

Further, in the bleaching solution containing the above-mentioned iron (III) ionic complex salt, other metal ionic complex salt other than iron complex salt, such as that of cobalt, copper, nickel, zinc, etc. may also be applicable.

In the bleaching solution used in the present invention, it is possible to exert an acceleration effect by incorporating an imidazole compound or a derivative thereof or at least one compound represented by the general formulae [I] through [IX] and the exemplified compounds thereof, which are disclosed in Japanese Patent Application No. 63-48931(1988).

Other than those bleach accelerating agents mentioned above, the exemplified compounds disclosed on pages 51 to 115 of Japanese Patent Application No. 60-263568(1985) and on pages 22 to 25 in Japanese Patent O.P.I. Publication No. 63-17445(1988) and those compounds disclosed in Japanese Patent O.P.I. Publications Nos. 53-95630(1978) and 53-28426(1978) may also be used.

These bleach accelerating compounds may be used either singly or more than two compounds in combination in a quantity ranging generally between 0.01 and 100 g, more preferably between 0.05 and 50 g and, most advantageously, from 0.05 to 15 g per liter of a bleaching solution.

When the bleach accelerating agent is added to the bleaching solution, it may be added as the agent per se, but it is usually added to the bleaching solution after being dissolved in an adequate solvent such as water, alkaline liquid, an organic acid, etc. or, if necessary, in an organic solvent such as methanol, ethanol, acetone, etc. and, then, this solution is added into the bleaching solution.

Preferable pH of the bleaching solution is usually more than 5.5 and, more desirably within a range between 2.5 and 5.5.

In this respect, the term "pH of the bleaching solution" means pH of a working solution when the light-sensitive silver halide photographic material is under treatment and it should be clearly distinguished from that of so-called a replenisher.

Preferable temperature of the bleaching solution is usually between 20° C. and 50° C. and, more advantageously, in a range between 25° C. and 45° C.

Processing period with the bleaching solution is usually preferably not longer than 40 seconds in the case of processing a color paper, more preferably not longer than 30 seconds and, most advantageously, not longer than 25 seconds. The effects of the present invention is most distinguishably obtainable in so-called rapid processing.

Herein, the term "processing period (or time)" is used in the meaning of a period of time between when the front end of a color photographic paper strip starts being dipped in the bleaching solution and when it gets out of the solution.

The bleaching solution usually comprises a halide compound such as ammonium bromide, potassium bromide, sodium bromide, etc.

Also, the solution can contain various kinds of fluorescent brightening agents, defoaming agent or surface active agents.

Preferable replenishing amount of the bleaching solution is, in the case of the color photographic paper, not more than 50 ml and, more preferably, not more than 30 ml.

In the case of a photographic color negative film, the preferable replenishing amount is not more than 180 ml/m and, more advantageously, not more than 140 ml/m2.

The less the replenishing amount is the more distinctive the effects of the present invention become.

It is advantageous that the replenishing solution for the bleaching solution mentioned above is made from a part of, or the whole of the overflowed bleaching solution used for processing different kinds of silver halide color photographic materials.

That is to say, in the case where two different kinds of color photographic materials are processed by two series of processing system, using, for example, bleaching solutions A and B, the overflowed bleaching solution A may be used as a replenisher for the bleaching solution B. In this case, the types of photographic materials to be processed with the bleaching solutions A and B should preferably be different, and various kinds of combinations for example, a combination of color negative film and a color printing paper; a color negative film or a color printing paper and a color reversal film or paper; two negative films (or printing papers) of which silver chloride content, silver bromide content, speeds, etc. are different may be possible.

According to a particularly advantageous embodiment of the present invention, a combination of a color negative film with a color printing paper is preferable.

In the present invention, for the purpose of enhancing the activity of the bleaching solution, it is possible to blow air or oxygen gas into a processing bath or a replenisher tank.

It is also possible to optionally incorporate into these baths an adequate oxidizing agent such as hydrogen peroxide, a bromic acid salt, a persulfate, etc.

Sodium hydroxide, potassium hydroxide, as a fixing agent used in a fixing solution in the fixing step, which usually follows after the bleaching step, a thiosulfate or a thiocyanate is employed advantageously.

Preferable amount of addition of the thiosulfate is not less than 0.4 mols per liter of the fixing solution.

Regarding the thiocyanate compound not less than 0.5 mol per liter of the fixing solution is preferable.

To the fixing solution, various kinds of additives other than these fixing agents mentioned above may optionally be added.

These additives include, for example, a pH buffer selected from a variety of salts, such as boric acid, borax, sodium hydroxide, potassium hydroxide, sodium carbonate, potassium carbonate, sodium bicarbonate, potassium bicarbonate, acetic acid, sodium acetate, ammonium hydroxide, etc.

These compounds are used either singly or two or more kinds in combination.

Further, it is advantageous that the fixing solution contains a large quantity of a halogenating agent, for example, alkali halides or ammonium halides such as potassium bromide, sodium bromide, sodium chloride, ammonium bromide, etc.

Still further the fixing solution may optionally contain other additives, which are usually employed in the conventionally known fixing solution. Those additives include, for example, a borate, an oxalate, an acetate, a carbonate, a phosphate, etc.; alkylamines, polyethylene oxides; etc.

Moreover, according to one of the most advantageous embodiments of the present invention, in the fixing solution, the content of an ammonium ion contained in the fixing solution is, preferably, not more than 50 mol. %, more preferably not more than 20 mol. % and, most advantageously, in a range between 0 and 10 mol. % in view of preventing stains from causing.

Decrease in the ammonium ion in the fixing solution can effect upon fixability of the solution, it is advisable and advantageous in the present invention that either to employ from 0.5 to 3.0 mols per liter of a thiocyanate compound in combination, or to adjust the content of the thiosulfate at 0.4 mols, more preferably not less than 1.0 mol and, most advantageously, in the range between 1.2 and 2.5 mols per a liter of the solution.

It is possible to recover silver from the fixing solution in any conventionally known manners; for example, by means of an electrolytical method, as disclosed in French Patent No. 2,299, 667; a precipitation method as disclosed in Japanese Patent O.P.I. Publication No. 52-73037 or German Patent No. 2,331,220; an ion exchange method as disclosed in Japanese Patent O.P.I. Publication No. 51-17114 and German Patent 2,548,237; a metal substitution method as disclosed in British Patent No. 1,353,805, etc. may advantageously be employed.

Although it is particularly advantageous for silver recovery to be carried out in the processing line by means of the electrolytical method or the ion exchange method, because the applicability to rapid process can be improved, it is also possible to recover silver from overflowed waste solution.

Replenishing amount of the fixing solution is preferably not more than 1200 ml, more preferably, in the range between 20 and 1000 ml and, most advantageously, in the range between 50 and 800 ml per a unit square meter of the photographic material.

Preferable pH range of the fixing solution is between 4 and 8.

It is also advantageous to add to the fixing solution used for the present invention a compound represented by formula [FA] disclosed in Japanese Patent Application No. 63-48931(1988) and any of those exemplified therein.

Due to the foregoing, it would be possible to obtain an effect that generation of sludge, which often takes place when a small quantity of photographic materials are processed over a long period of time with the fixing solution, can be prevented effectively.

These compounds represented by the above-mentioned formula [FA] may be synthesized according to the manner, for example, as disclosed in the U.S. Pat.

Nos. 3,335,161 or 3,260,718. These compounds may be used either singly or two or more kinds in combination.

The compound represented by the formula [FA] may usually be employed in the processing solution in an amount ranging from 0.1 to 200 g per liter of the processing solution.

In the fixing solution, it is possible to use a sulfite or a compound which is capable of releasing it, i.e., a sulfite precursor.

As concrete examples for these compounds, potassium sulfite, sodium sulfite, ammonia sulfite; ammonium hydrogen sulfite, potassium hydrogen sulfite, sodium hydrogen sulfite; potassium meta-bisulfite, sodium meta bisulfite, ammonium meta bisulfite, etc. may be mentioned.

Further, those compounds represented by the formula [B-1] or [B-2] may also be used.

These sulfites and sulfite-releasing compounds may preferably be contained in the processing solution at least in a quantity of not less than 0.05 mol per liter of the fixing solution; more advantageously in a range between 0.08 and 0.65 mol/liter and, most advantageously, in a range between 0.10 and 0.50 mol/liter. It is particularly advantageous in the present invention that the fixing solution contains from 0.12 to 0.40 mol of sulfite ion per liter of the fixing solution.

Processing period of the fixing solution may optionally be selected, and it is generally preferable that this is not more than 6 minutes and 30 seconds, more preferably in a range between 5 seconds and 4 minutes 20 seconds and, most advantageously, in a range between 10 seconds and 3 minutes 20 seconds.

According to a preferable embodiment of the present invention, the bleaching solution and the fixing solution are preferably subjected to forcible agitation.

This is because not only in view of achieving the objects of the present invention but also in the view of enhancing adaptability to rapid process.

Herein, the term "forcible agitation" does not mean normal transportation of the processing solution in the bath by means of diffusion, but means "to stir the solution forcibly by installing a stirring means.

As the forcible stirring means, for example, means as disclosed in Japanese Patent Application No. 63-48930(1988) or Japanese Patent O.P.I. Publication 1-206343(1989) can be employed.

In the present invention, a term so-called "cross-over time" between respective solution baths, which means a period of time, while the photographic material is transported from one of the processing solution baths, to a subsequent bath, for example, from a color developer bath to a bleach bath is usually less than ten seconds and, preferably, not longer than seven seconds in view of preventing occurrence of fog due to bleach treatment.

Further, it is also preferable to install so-called a "Duckhill" valve for the purpose of decreasing the amount of a processing solution which is brought in by the photographic material.

In the present invention, it is advantageous that a stabilizing treatment by the use of a stabilizing solution is employed subsequent to a rinsing process, which usually follows the fixing process.

In view of effectively achieving the objects of the present invention, it is advantageous for the stabilizing solution to contain a chelating agent of which stability constant is not less than 8.

Herein, the term "chelate stability constant" is used in a usual meaning as defined in, for example, "Stability Constants of Metal-ion Complexes", written by L. G. Sillen and A. E. Martell, published by The Chemical Society, London(1964); "The Organic Sequestering Agents" written by S. Chabarek and A. E. Martell, published by Wiley(1959); etc.

As chelating agents, of which stability constant of the iron ion is not less than 8, for example, organic carboxylic acid chelating agents, organic phosphoric acid chelating agents, inorganic phosphoric acid chelating agents, polyhydroxyl compounds may be mentioned.

In this respect, the above-mentioned iron ion means a ferric ($Fe^{3+}$) ion.

The amount of the above-mentioned chelating agent to be used in the stabilizing solution is usually in a range between 0.01 and 50 g, and more advantageously between 0.05 and 20 g per a unit liter of a stabilizing solution.

As a preferable additive to be added to the stabilizing solution, ammonium compounds can be mentioned.

These ammonium compounds may be supplied by various kinds of ammonium salts of inorganic compounds. These compounds may be used either singly or in combination.

The amount of the ammonium compounds to be used in the stabilizing solution is usually in a range between 0.001 and 1.0 mol, and more advantageously between 0.002 and 2.0 mols per liter of a stabilizing solution.

Further in the stabilizing solution, it is advantageous to contain a sulfite.

Said sulfite may be anyone which is capable of releasing a sulfite ion. Although it may be either an organic compound or an inorganic compound, inorganic salt is preferable.

Preferable compounds include, for example, sodium sulfite, potassium sulfite, ammonium sulfite, ammonium bisulfite, potassium bisulfite, sodium metabisulfite, potassium metabisulfite, ammonium metabisulfite and hydrosulfite. The above-mentioned sulfite salt is preferably added to the stabilizing solution in quantities of at least $1 \times 10^{-3}$ mol/liter, and, more preferably in a range between $5 \times 10^{-3}$ and $1 \times 10^{-1}$ mol/liter. The addition of the sulfite salt is effective for preventing stains.

The sulfite salt may be added directly to the stabilizing solution, however, it is preferable for the compound to be added to a replenishing solution for the stabilizing solution.

As other additives, which may be added to the stabilizing solution, for example, polyvinyl pyrrolidones such as PVP K-15, K-30 or K-90; or salts of organic acids, such as those of citric acid, acetic acid, succinic acid, oxalic acid, benzoic acid, etc.; pH adjusting agent such as phosphates, borates, hydrochloric acid sulfuric acid, etc.; anti-mold such as phenol derivatives, catechol derivatives, imidazole derivatives, triazole derivatives, thiabendazole derivatives, organic halide compounds and other antimolds known as a slime controlling agent in the paper mills and pulp industries, etc.; fluorescent brightening agents, surface active agents, anticeptics and metal salts of bismuth, magnesium, zinc, nickel, aluminium, tin, titanium, zirconium, etc. may be mentioned.

These compounds may be used either singly or two or more kinds in combination in an optional amount with a proviso that it does not injure the effects of the present invention.

In the method of the present invention, any rinsing step is not necessary subsequent to the stabilizing process but, if necessary, it is optional to add a rinsing process or washing of the surface of the photographic material using a small amount of water and for a short period of time.

It is also preferable to make a soluble iron salt present in the stabilizing solution.

The soluble iron salt is used in the stabilizing solution in an amount of at least $5\times10^{-3}$ mols/liter and, more preferably, in a range between $8\times10^{-3}$ and $150\times10^{-3}$ mols/liter. According to one of the most preferable embodiments of the present invention, the amount is in a range between $12\times10^{-3}$ and $100\times10^{-3}$ mols/liter. These soluble iron salt may also be added to the stabilizing solution either by adding to a replenishing solution for the stabilizing solution, by incorporating into the photographic material so that they are dissolved out from the photographic material into the stabilizing solution or by adding to a bath preceding to the process by the stabilizing solution so that they may be carried into the stabilizing solution by the photographic material.

In the present invention, it may also be possible to use a stabilizing solution of which calcium ion and magnesium ion content is restrained below 5 ppm by subjecting the solution to ion exchange treatment.

In addition, this stabilizing solution may contain the above-mentioned antimold or a halogen ion-releasing compound.

In the present invention, pH value of the stabilizing solution is preferably in a range between 5.5 and 10.0.

A pH adjusting agent to be contained in the stabilizing solution, any of conventionally known acidic or alkaline compound may be used.

Upon stabilizing treatment, temperature of the stabilizing solution is, preferably, in a range between 15° C. and 70° C. and more preferably between 20° C. and 55° C.

The processing period of time is preferably less than 120 seconds, more preferably, between 3 and 90 seconds, and most preferably between 6 and 50 seconds.

Replenishing amount of the stabilizing solution is preferably from 0.1 to 50 times as much as that carried over from the previous bath, i.e., bleach-fixing bath in view of adaptability of the solution to rapid process and preservability of developed dye images.

The stabilizing bath preferably consists of plurality of baths, i.e., preferably two to six baths and, more preferably, two to three baths.

Most advantageously, the stabilising bath consists of two baths and so-called a counter flow system, i.e., a method in which a processing solution is supplied to a rear bath and over lowed out from a front bath, is employed.

In the light-sensitive silver halide photographic material used in the present invention, various kinds of dye-forming substances may be employed and, most typically and dye-forming couplers can be mentioned.

As yellow dye-forming couplers, conventionally known acylacetanilide-type couplers may be used advantageously.

Among them, benzoyl acetanilide compounds and pyvaloyl acetanilide compounds are particularly advantageous.

Concrete examples of the yellow dye-forming couplers include, for example, those disclosed in British Patent No. 1,077,874; Japanese Patent Publication No. 45-40757(1970); Japanese Patent O.P.I. Publication Nos. 47-1031(1972), 47-26133(1972), 48-94432(1973), 50-87650(1975), 51-3631(1976), 52-115219(1977), 54-133329(1979) 56-30127(1981); U.S. Pat. Nos. 2,875057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155, 4,401,752, etc.

Non-diffusible yellow dye-forming couplers which may preferably be used in the photographic material of the present invention are those represented by the following general formula [Y]:

Formula [Y]

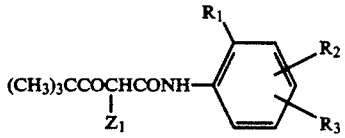

wherein $R_1$ represents a halogen atom or an alkoxy group; $R_2$ is selected from a hydrogen atom, a halogen atom and an alkoxy group which may have a substituent; $R_3$ is selected from an acylamino group, an alkoxy carbonyl group, an alkyl sulphamoyl group, an arylsulfon amide group, an alkyl ureido group, an aryl ureido group, a succinic imide group, an alkoxy group and an aryloxy group, provided that these groups may have a substituent; and $Z_1$ represents a group which is capable of being split-off from the residual group upon coupling reaction with an oxidation product of a color developing agent.

In the present invention, a magenta dye-forming coupler represented by the following general formulae [M] and [M-I] may advantageously be used.

Formula [M]

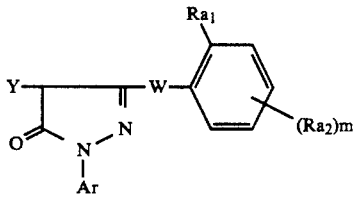

wherein Ar represents an aryl group in the formula: $Ra_1$ represents a hydrogen atom or a substituent thereof: $Ra_2$ represents a substituent and Y represents a hydrogen atom or a substituent thereof which is capable of being split-off from the residual group upon coupling reaction with an oxidation product of a color developing agent.

Formula [M-I]

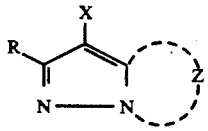

wherein Z represents in the formula a group of non-metal atoms necessary to complete a nitrogen atom-containing heterocyclic ring which may have a substituent: X represents a hydrogen atom or a substituent thereof which is capable of being split-off from the residual group upon coupling reaction with an oxidation product of a color developing agent: and R represents a hydrogen atom or a substituent thereof.

There is no particular limitation for the substituent represented by R and, for example, an alkyl group, an aryl group an anilino group, an acylamino group, a sulfon amide group, an alkylthio group, an arylthio group, an alkenyl group, a cycloalkyl group, etc. can be mentioned.

It also includes a halogen atom, a cycloalkenyl group, an alkynyl group, a heterocyclic group, a sulphonyl group, a sulphinyl group, a phosphonyl group, an acyl group, a carbamoyl group, a sulphamoyl group, a cyano group, an alkoxy group, an aryloxy group, a heterocyclic oxy group, xyloxy group, an acyloxy group, a carbamoyl-oxy group, an amino group, an alkylamino group, an imide group, an ureido group, a sulphamoyl amino group, an alkoxycarbonyl amino group, an aryloxycarbonyl group, a heterocyclic thio group, spiro-compound residues and bridged hydrocarbon compound residues, etc.

As for the alkyl group represented by R, those having 1 to 32 carbon atoms are preferable and they may be either straight chained or branched alkyls.

As for the aryl group represented by R, a phenyl group is preferable.

As for the acyl amino group represented by R, an alkylcarbonyl amino group, an arylcarbonyl amino group, etc. may be mentioned.

As for the sulfon amide group represented by R, an alkylsulfonyl amino group, an arylsulfonyl amino group, etc. may be mentioned.

As for the alkyl or aryl part of the alkylthio group and the arylthio group represented by R, those mentioned above are mentioned.

As for the alkenyl group represented by R, those having 2 to 32 carbon atoms are preferable and they may be either straight chained or branched. In the case of cyclic alkyl group, those having three to 12 carbon atoms and, particularly, those having five to seven carbon atoms are preferable.

As for the ciclic alkenyl group represented by R, those having 3 to 12 carbon atoms and, particularly, those having five to seven carbon atoms are preferable.

As for the ciclic sulfonyl group represented by R, an alkyl sulfonyl group, an aryl sulfonyl group, etc.; as for the sulfinyl group, an alkyl sulfinyl group, as for the phosphonyl group, an alkyl phosphonyl group, an aryl phosphonyl group; etc.; an aryl sulfinyl group, etc.; as for the phosphonyl group, an alkyl phosphonyl group, an alkoxy phosphonyl group, an aryl phosphonyl group, etc.; as for the acyl group, an alkyl carbonyl group, an aryl carbonyl group; etc.; as for the carbamoyl group, an alkyl carbamoyl group, an aryl carbamoyl group; etc.; as for the sulfamoyl group, an alkyl sulfamoyl group, an aryl sulfamoyl group; etc.; as for the acyloxy group, an alkyl carbonyloxy group, an aryl carbonyloxy group; etc.; as for the carbamoyloxy group, an alkyl carbamoyloxy group, an aryl carbamoyloxy group; etc.; as for the ureido group, an alkyl ureido group, an aryl ureido group; etc.; as for the sulfamoyl amino group, an alkyl sulfamoylamino group, an aryl sulfamoylamino group etc.; as for the heterocyclic group, those of five to seven membered rings are preferable and, more concretely, 2-furyl group, 2-thienyl group, 2-pyridinyl group, 2-benzothiazolyl group, etc.; as for the heterocyclicoxy group, those of five to seven membered rings are preferable and, more concretely, for example, 3,4,5,6-tetrahydropyranyl-2-oxy group, 1-phenyltetrazol-5-oxy group, etc.; as for the heterocyclic thio group, those of five to seven membered rings are preferable and, more concretely, for example, 2-pyridyl thio group, 2-benzothiazolyl thio group, 2,4-diphenoxy-1,3,5-triazole-6-thio group, etc.; as for the siloxy group, for example, trimethyl siloxy group-triethyl siloxy group, dimethyl butyl siloxy group, etc.; as for the imide group, a succinic imide group, 3-heptadecyl succinic imide group, a phthal-imide group, a glutal-imide group, etc.; as for the spiro compound residues, for example, spiro[3,3]heptane-1-yl, etc.; and as for the bridged hydrocarbon compound residues, for example, a bicyclic[2,2,1]heptane-1-yl, tricyclic[3,3,1,3,7]decane-1-yl, 7,7-dimethyl-bicyclic[2,2,1-]heptane-1-yl, etc. may be mentioned.

As the group which is capable of being split-off from the residual group upon coupling reaction with an oxidation product of a color developing agent, for example, a halogen atom, such as chlorine atom, bromine atom, fluorine atom, etc.; an alkoxy group, an aryloxy group, a heterocyclicoxy group, an acyloxy group, a sulfonyloxy group, an alkoxycarbonyl group, an aryloxy carbonyl group, an alkylthio group, an arylthio group, a heterocyclicthio group, an alkyloxy-thio-carbonylthio group, an acyl amino group, a sulfon amide group, a nitrogen atom-containing heterocyclic group, which is connected through a nitrogen atom, with the coupling position of the coupler; an alkyloxy carbonyl amino group, an aryloxy carbonyl amino group, a carboxyl group,

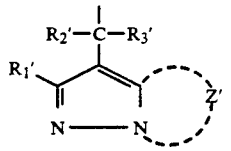

wherein, $R_1'$ represents the same atoms or groups as R in the formula [M], Z' is the same as Z herein-before defined; $R_2'$ and $R_3'$ are independently selected from a hydrogen atom, an alkyl group, an aryl group and a heterocyclic group, and Z' is preferably a halogen atom (particularly a chlorine atom).

As the nitrogen atom-containing heterocyclic group including the above-mentioned Z or Z', a pyrazole ring, an imidazole ring, a tetrazole ring, etc. may be mentioned and as the substituent that those heterocyclic rings can have, the same substituents as mentioned for R can be mentioned.

The magenta dye-forming coupler represented by the general formula [M-I] includes the compounds represented by the following general formulae [M-II] through [M-VII].

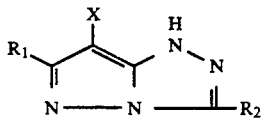

Formula [M-II]

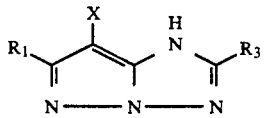

Formula [M-III]

-continued

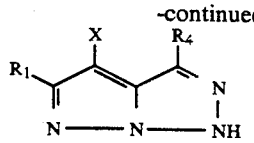

Formula [M-IV]

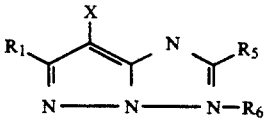

Formula [M-V]

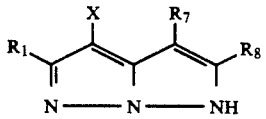

Formula [M-VI]

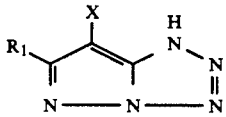

Formula [M-VII]

Of the formula [M-I], the preferable is one represented by the following formula [M-VIII].

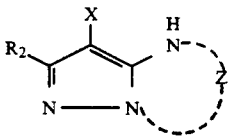

Formula [M-VIII]

wherein $R_1$, X and $Z_1$ are the same as R, X and Z in the formula [M-I] respectively.

Of magenta couplers represented by the above-mentioned formulas [M-II] through [M-VII], the particularly preferable is a magenta coupler represented by formula [M-II].

As a substituent capable of being owned by a ring formed by Z in formula [M-I] and by a ring formed by $Z_1$ in formula M-VIII], and $R_2$ through $R_8$ in formulas [M-II] through [M-VI], the following formula [M-IX] is preferable.

$$-R^1-SO_2-R^2 \qquad \text{Formula [M-IX]}$$

wherein $R^1$ represents an alkylene group, $R_2$ represents an alkyl group, a cycloalkyl group or an aryl group.

The carbon number of alkylene group represented by $R^1$ at the straight chain portion is preferably not less than 2, more preferably 3 to 6. It may be either straight-chained or branched-chained.

As a cycloalkyl group represented by $R_2$, 5- or 6-membered ones are preferable.

When the present invention is employed for forming positive images, the most preferable as substituents R and $R_1$ on the above-mentioned heterocyclic ring is one represented by the following formula [M-X].

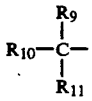

Formula [M-X]

wherein $R_9$, $R_{10}$ and $R_{11}$ are the same as the above-mentioned R.

Besides, two among the above-mentioned $R_9$, $R_{10}$ and $R_{11}$, for example $R_9$ and $R_{10}$ may be linked together to form a saturated or unsaturated ring (for example, a Cycloalkanes, a cycloalkenes or a heterocycle ring). In addition, $R_{11}$ may be linked with said ring to constitute a bridged hydrocarbon compound residual.

Of formula [M-X], the preferable are either (i) wherein at least 2 of $R_9$ through $R_{11}$ are alkyl groups or (ii) wherein One Of $R_9$ through $R_{11}$, for example $R_{11}$, is a hydrogen atom and the other two of $R_9$ and $R_{10}$ are linked together to form a cycloalkyl group with an carbon atom at the substituting-site.

In addition, of the above-mentioned (i), the preferable is the case when 2 of $R_9$ through $R_{11}$ are alkyl groups and the other one is either a hydrogen atom or an alkyl group.

Besides, when the present invention is used for forming a negative image, the most preferable for the above-mentioned substituents R and $R^1$ on the heterocyclic ring is one represented by the following formula [M-XI].

$$R_{12}-CH_2- \qquad \text{Formula [M-XI]}$$

wherein $R_{12}$ is the same as the above-mentioned $R_{12}$. As $R_{12}$, the preferable is a hydrogen atom or an alkyl group.

The following are the typical examples of this compound.

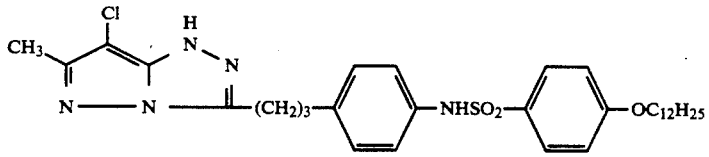

1

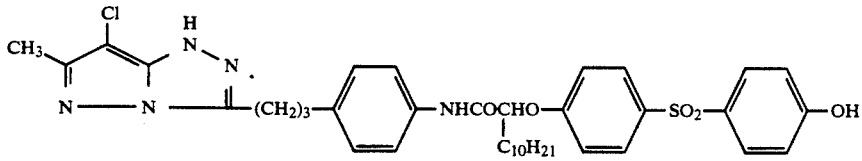

2

-continued
3
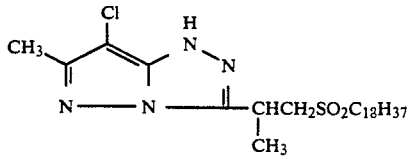
4
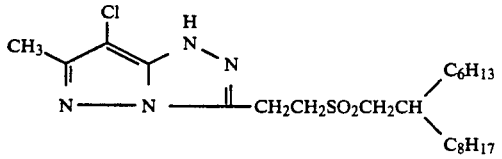
5
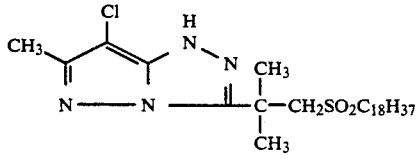
6
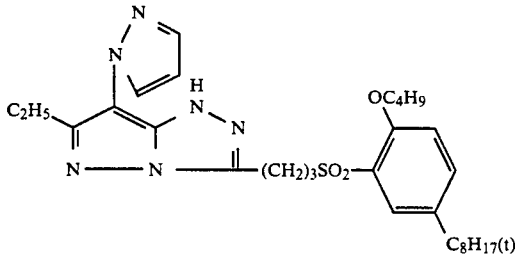
7
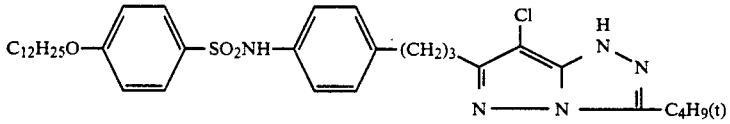
8
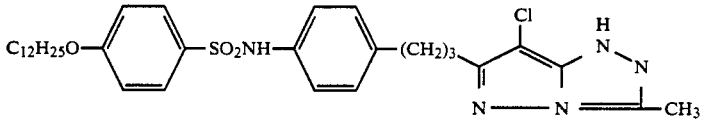
9
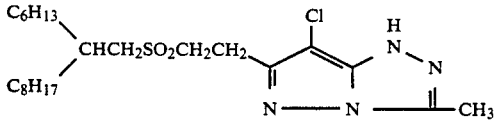
10
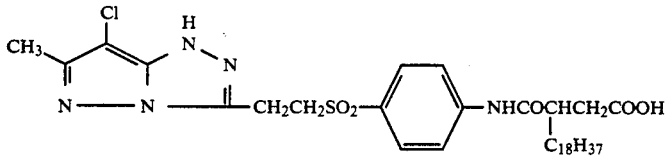
11
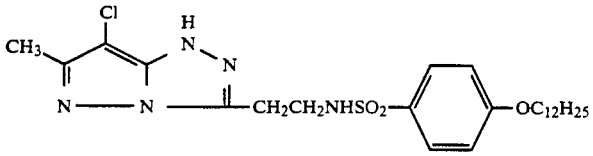

-continued
12
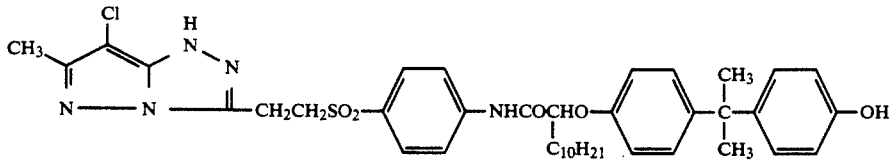
13
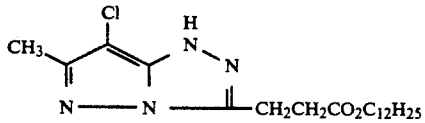
14
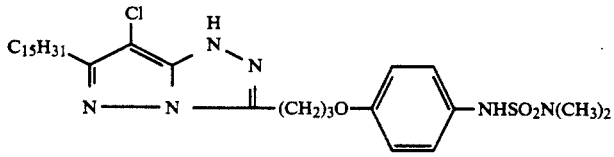
15
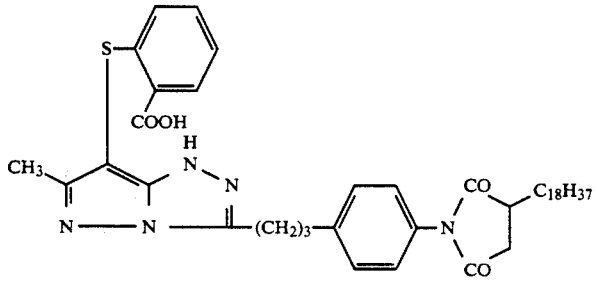
16
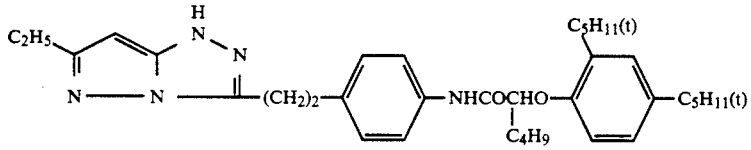
17
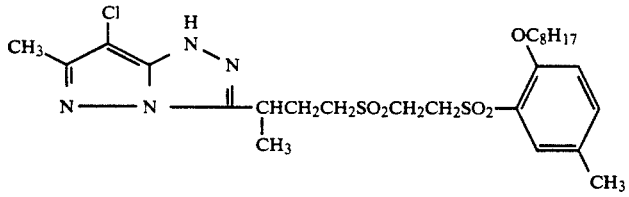
18
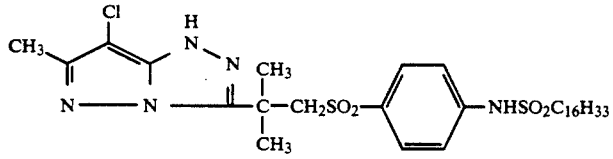
19
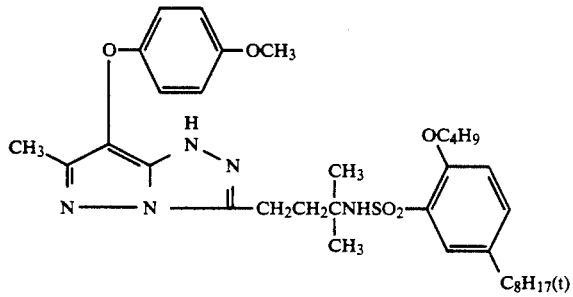

-continued
20
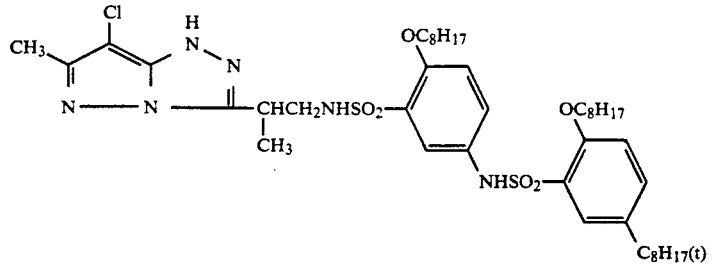
21
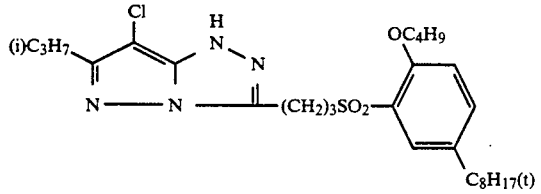
22
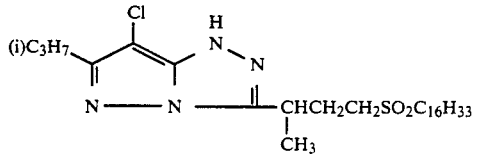
23
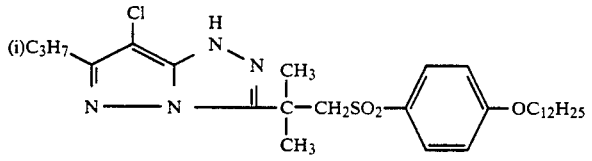
24
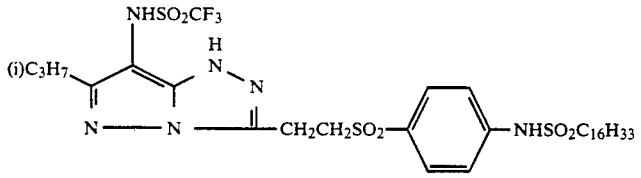
25
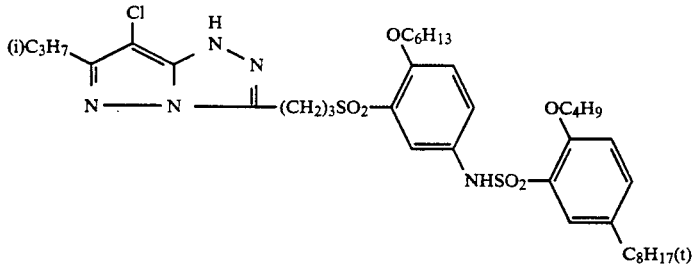
26
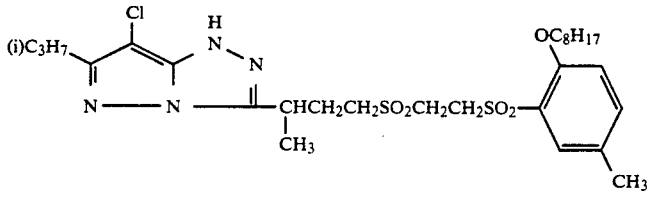

-continued
27
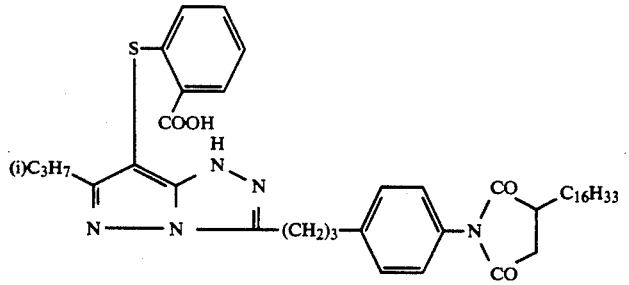
28
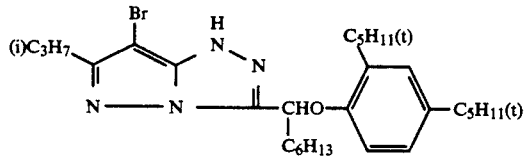
29
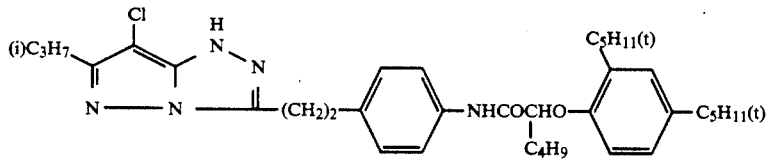
30
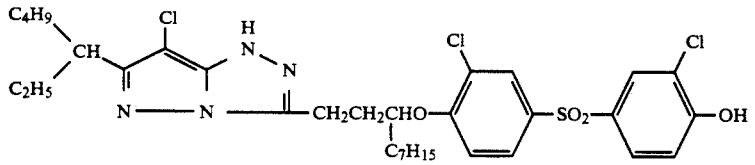
31
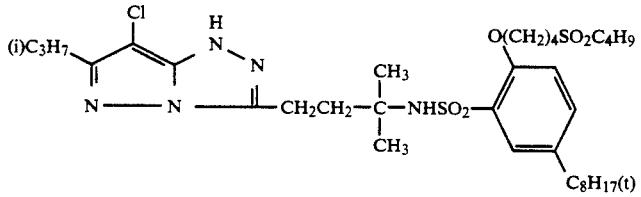
32
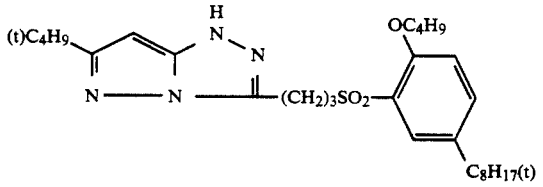
33
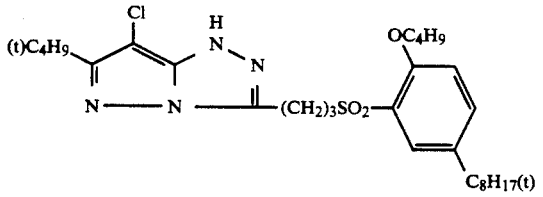
34
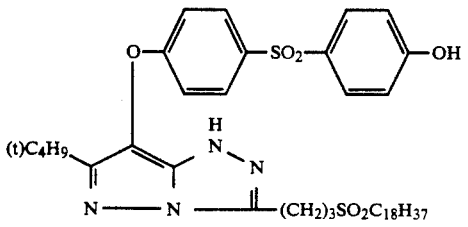

-continued
35
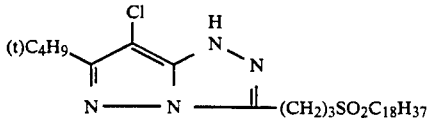
36
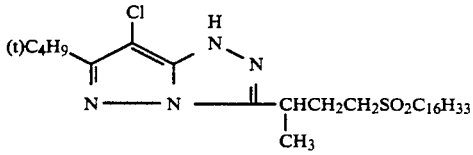
37
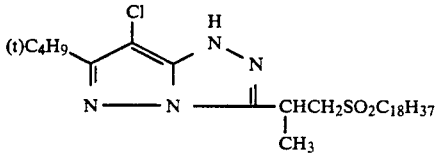
38
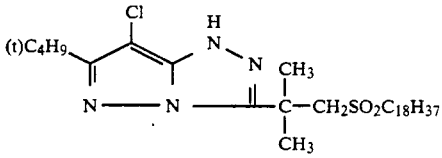
39
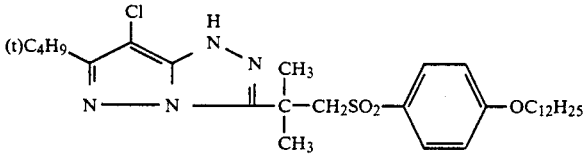
40
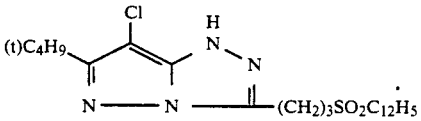
41
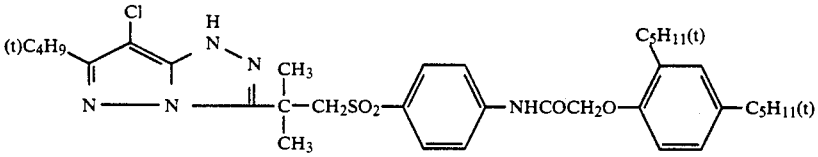
42
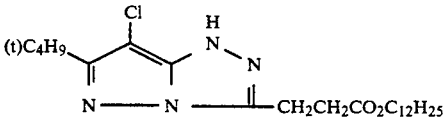
43
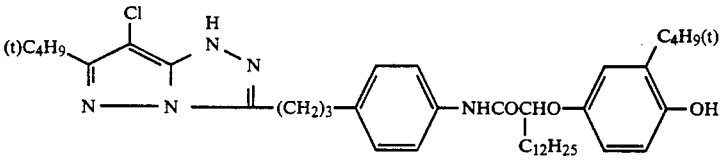
44
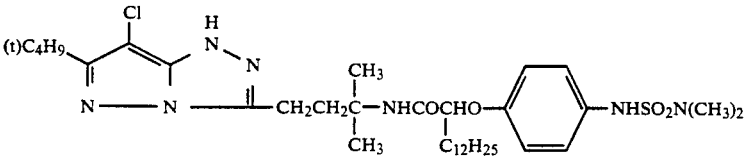

-continued
45
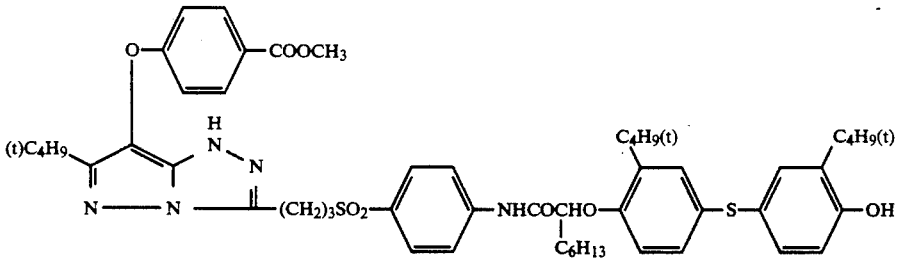
46
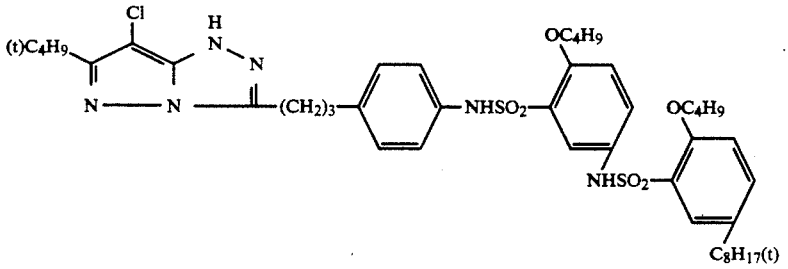
47
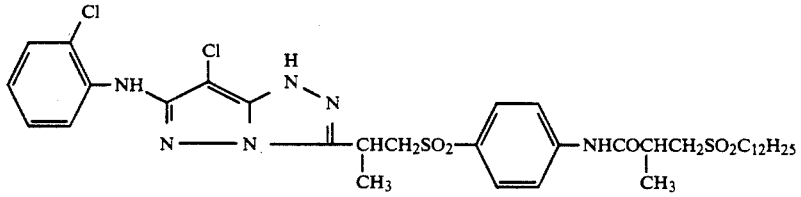
48
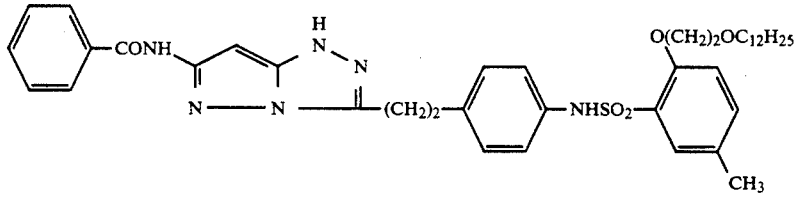
49
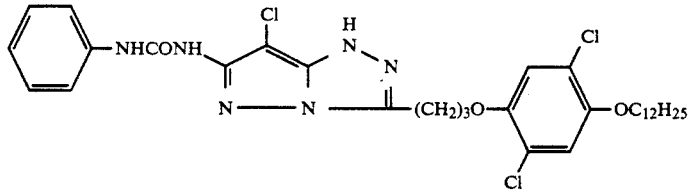
50
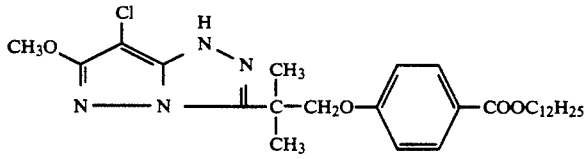
51
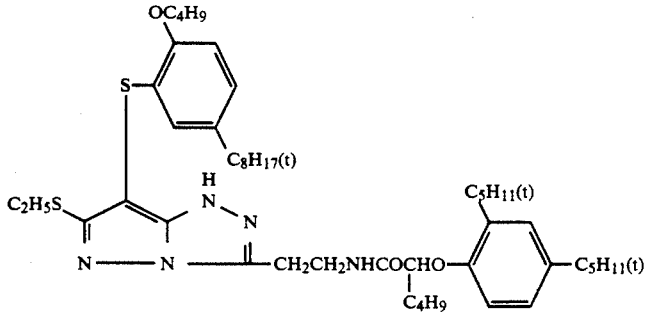

-continued
52
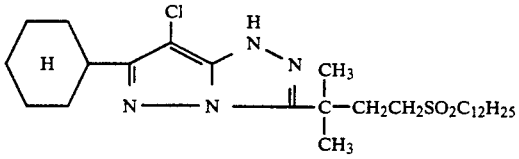
53
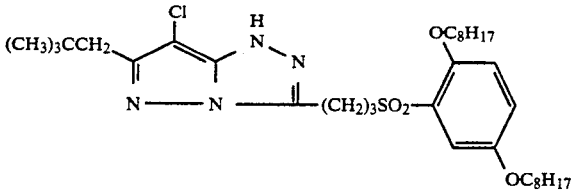
54
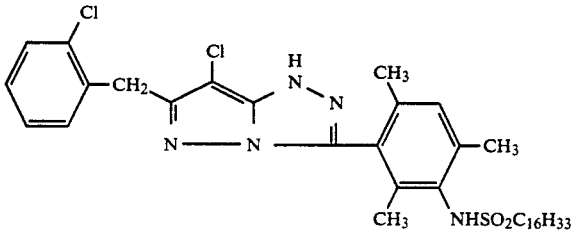
55
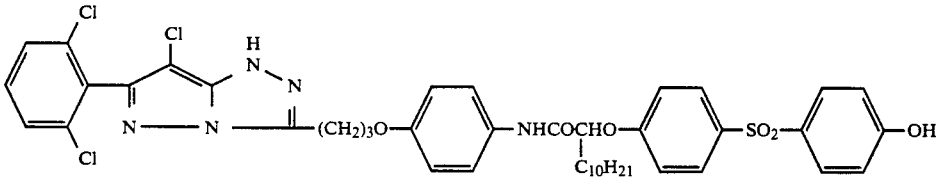
56
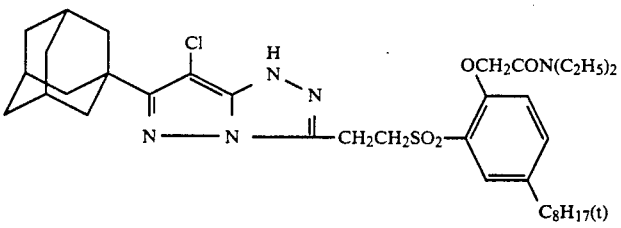
57
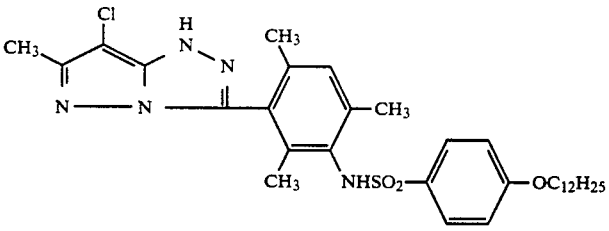
58
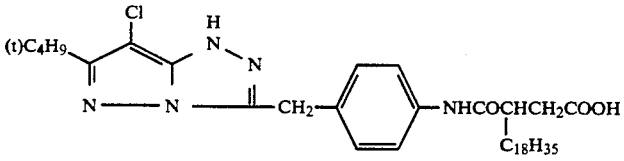
59
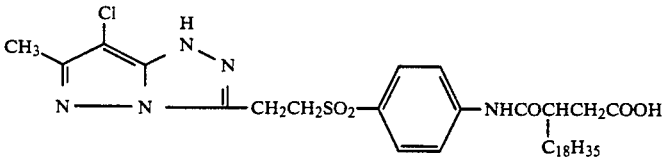

-continued
60
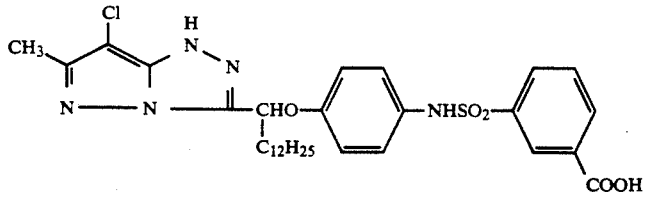
61
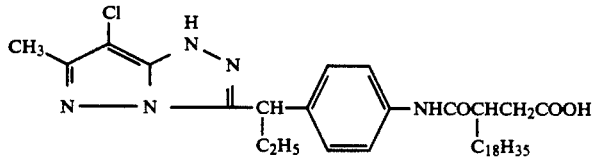
62
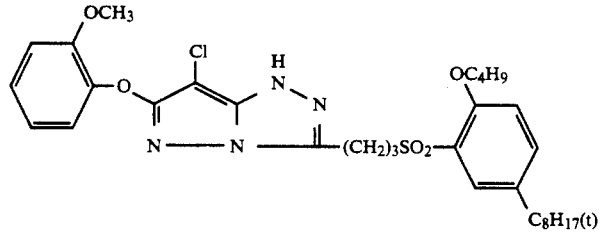
63
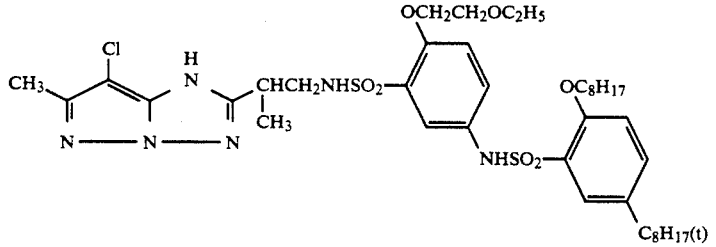
64
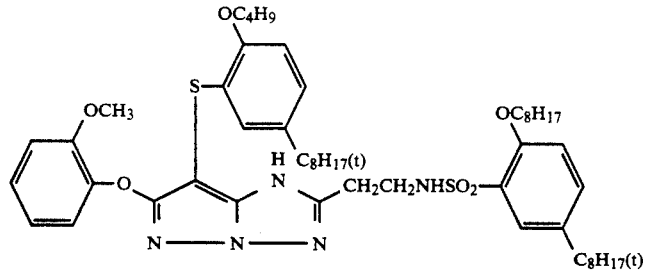
65
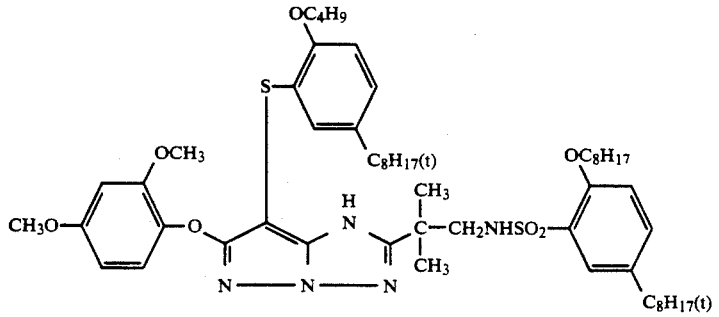

-continued
66
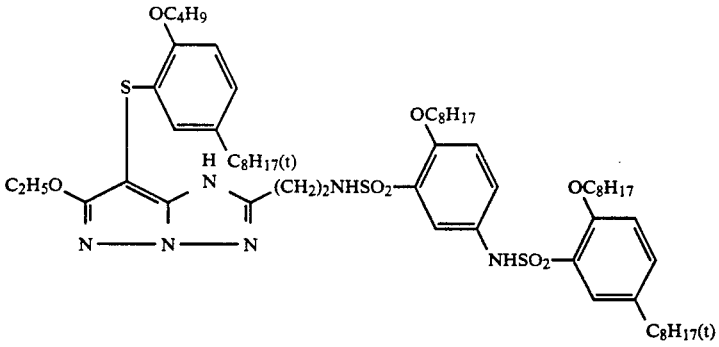
67
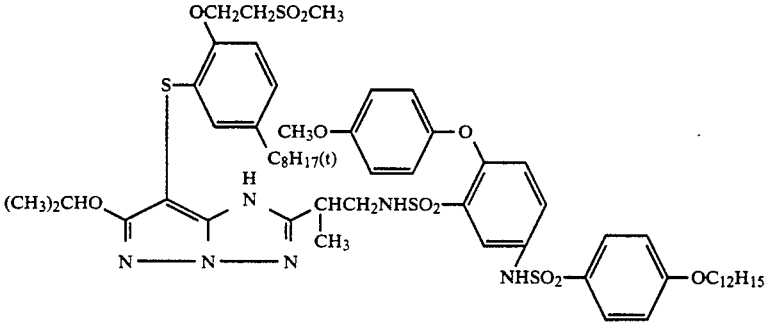
68
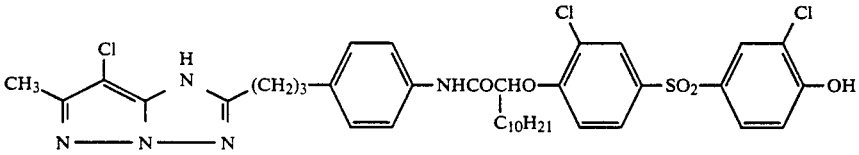
69
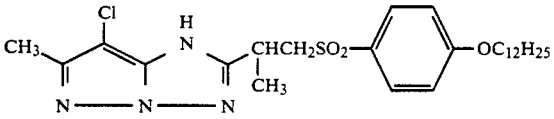
70
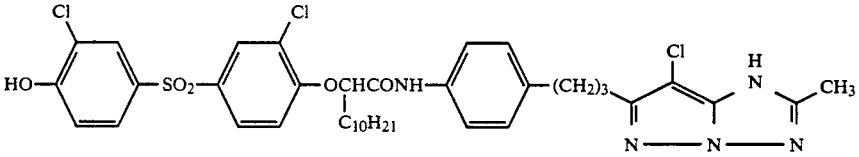
71
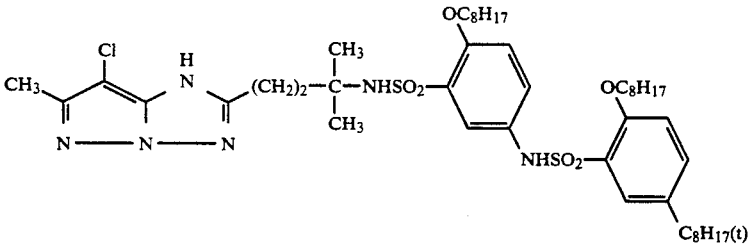
72
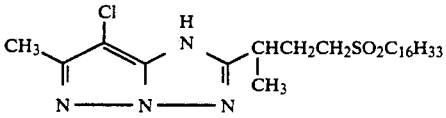
73
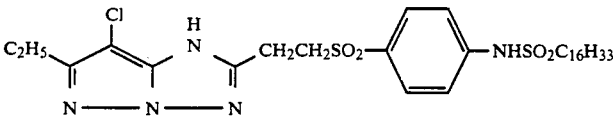

-continued
74
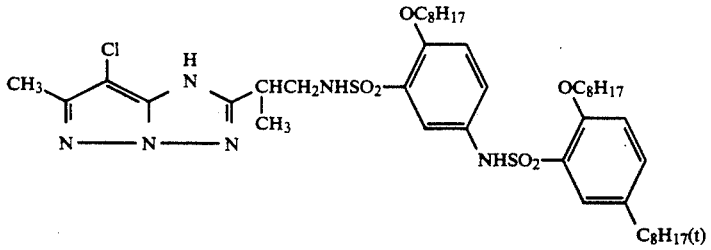
75
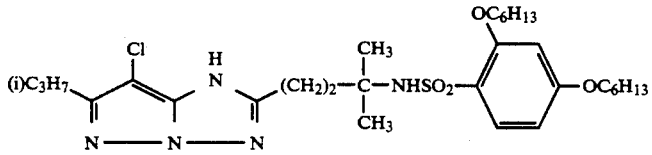
76
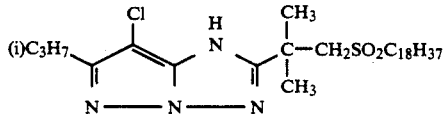
77
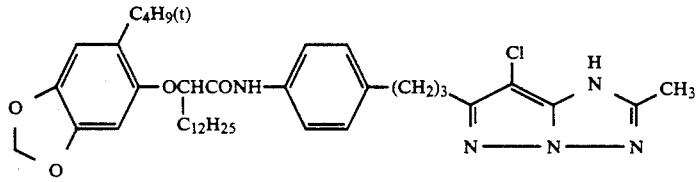
78
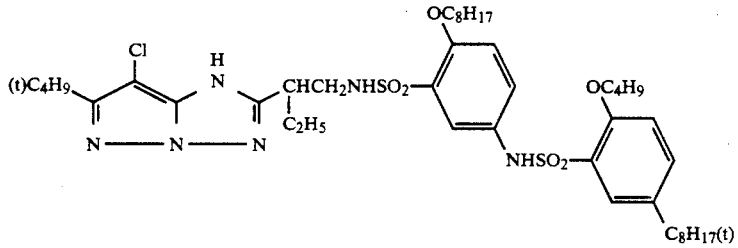
79
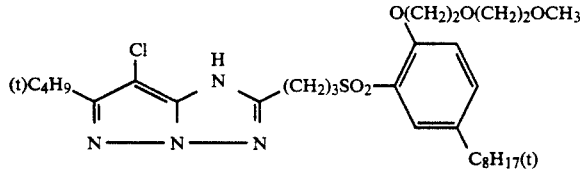
80
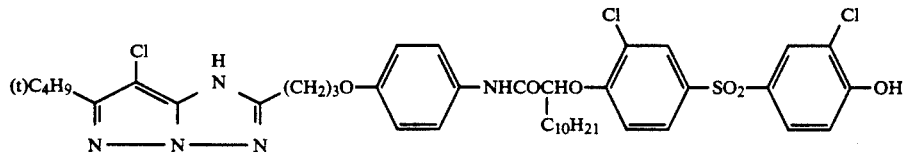
81
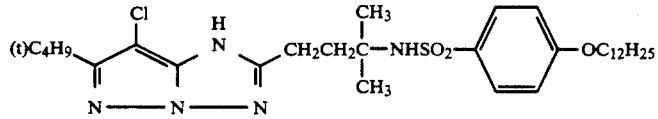
82
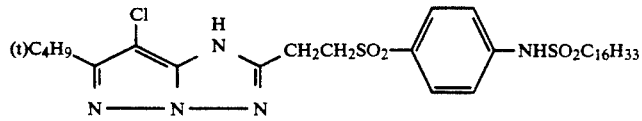

-continued
83
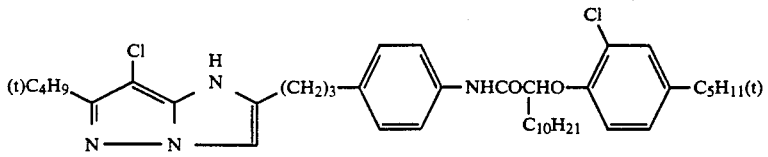
84
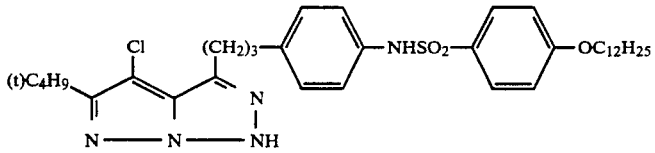
85
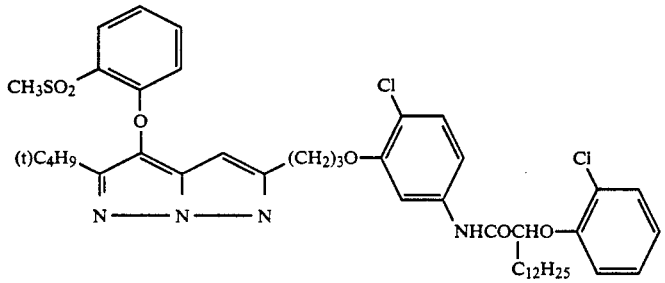
86
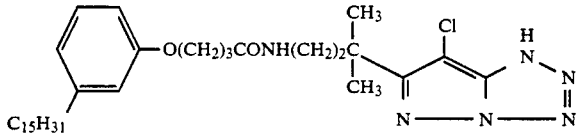
87
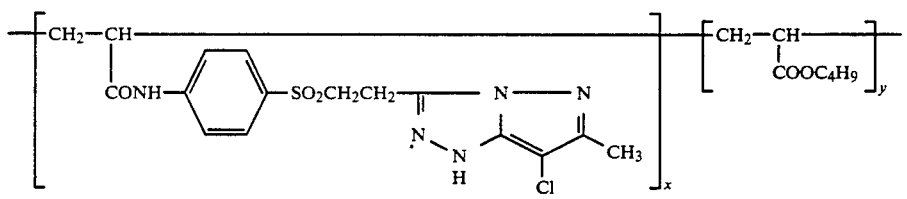
x:y = 50:50
88
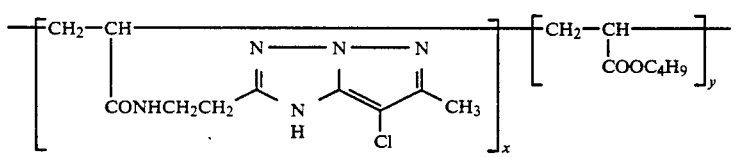
x:y = 50:50
89
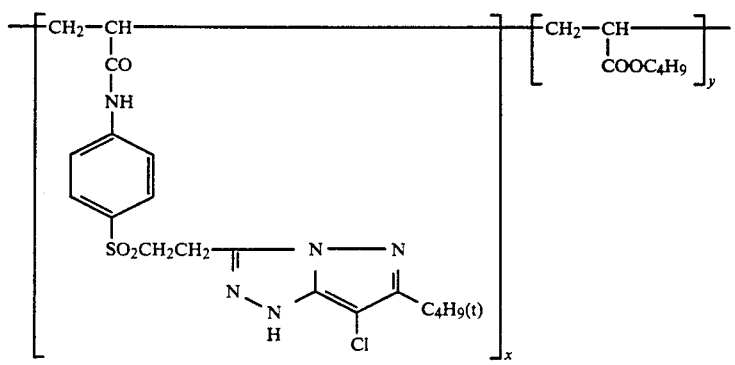
x:y = 50:50

-continued

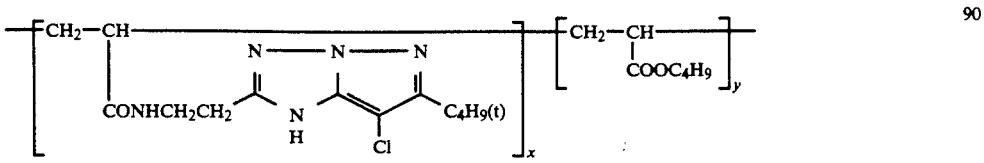

x:y = 50:50

In addition to the above-mentioned typical examples of the compound, as typical examples of the above-mentioned compound, there may be cited the compounds shown as Nos. 1 through 4, 6, 8 through 17, 19 through 24, 26 through 43, 45 through 59, 61 through 104, 106 through 121, 123 through 162, 164 through 223, among compounds described on pages 18 through 32 in Japanese Patent Publication Open to Public Inspection (hereinafter referred to as "Japanese Patent O.P.I. Publication") No 16633/1987.

In addition, the above-mentioned couplers can be synthesized in reference to methods described in *Journal of the Chemical Society*, Perkin I (1977), pages 2047 to 2052, U.S. Pat. No. 3,725,067, Japanese Patent O.P.I. Publication Nos. 99437/1984, 42045/1983, 162548/1984, 171956/1984, 33552/1985, 43659/1985, 172982/1985, 190779/1985, 209457/1987 and 307453/1988.

The above-mentioned coupler can be used in the range of $1 \times 10^{-3}$ to 1 mol, preferably $1 \times 10^{-2}$ to 8 x $10^{-1}$ mol per mol of silver halide.

In addition, the above-mentioned coupler can be used together with other kinds of magenta couplers.

As a cyan dye forming coupler, phenol-type or naphtol-type 4-equivalent or 2-equivalent cyan dye forming coupler are typical. They are described in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patent Nos. 478,991, 945,542, 1,084,480, 1,377,233, 1,388,024 and 1,543,040 and Japanese Patent O.P.I. Publication Nos. 374,25/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984 and 11724/1985.

As a cyan dye forming coupler, couplers illustrated by the following formulas [E] and [F] can be used preferably.

Formula [E]

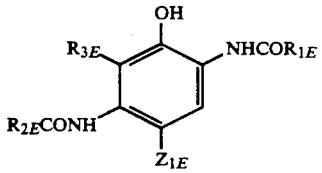

wherein $R_{1E}$ represents an aryl group, a cycloalkyl group or a heterocyclic group. $R_{2E}$ represents an alkyl group, a cycloalkyl group or a heterocyclic group. $R_{2E}$ represents an alkyl group or a phenyl group. $R_{3E}$ represents a hydrogen atom, a halogen atom, an alkyl group or an alkoxy group.

$Z_{1E}$ represents a hydrogen atom, a halogen atom or a group capable of splitting off upon reaction with an oxidized product of an aromatic primary amine-type color developing agent.

Formula [F]

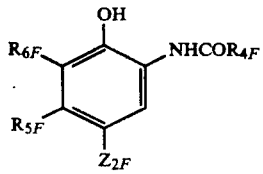

wherein $R_{4F}$ represents an alkyl group (for example, a methyl group, an ethyl group, a propyl group, a butyl group and a nonyl group) and $R_{5F}$ represents an alkyl group (for example, a methyl group and an ethyl group).

$R_{6F}$ represents a hydrogen atom, a halogen atom (for example, fluorine, chlorine and bromine) or an alkyl group (for example, a methyl group and an ethyl group).

$Z_{2F}$ represents a hydrogen atom, a halogen atom or a group capable of splitting off upon reaction with an oxidized product of an aromatic primary amine-type color developing agent.

In the present invention, it is preferable to use a cyan coupler illustrated by the following formula [C-1] which enhances the effect of the present invention additionally.

Formula [C-1]

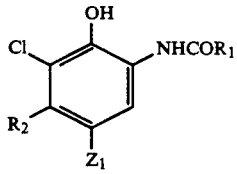

wherein $R_1$ represents a balast group, and $R_2$ represent an alkyl group having the carbon number of not less than 2. $Z_1$ represents a hydrogen atom or a group capable of splitting off upon reaction with an oxidized product of color developing agent.

In the cyan coupler illustrated by the above-mentioned formula [C-1], an alkyl group represented by $R_2$ may be either straight-chained or branched-chained, and it includes those having a substituent.

$R_2$ is preferably an alkyl group having 2 to 6 carbon atoms.

A balast group represented by $R_1$ is an organic group having size and form giving enough volume to coupler molecules for preventing the coupler from diffusing substantially to other layers from a layer to which the coupler is applied.

For said balast group, the preferable are those illustrated by the following formula.

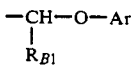
Formula [C-1-A]
wherein $R_{B1}$ represents an alkyl group having 1 to 12 carbon atoms. Ar represents an aryl group such as a phenyl group. This aryl group includes those having substituents.
Next, the following are the practical examples of couplers illustrated by [C-1].
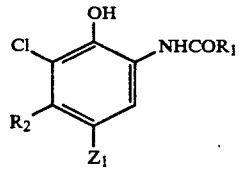
| Coupler No. | $R_2$ | $Z_1$ | $R_1$ |
|---|---|---|---|
| C-1-1 | $-C_2H_5$ | $-Cl$ | 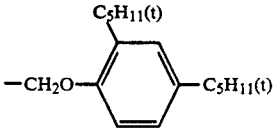 |
| C-1-2 | $-C_2H_5$ | 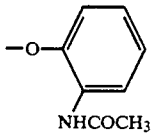 | 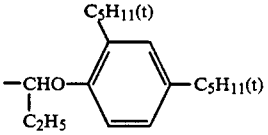 |
| C-1-3 | $-C_3H_7(i)$ | $-Cl$ | 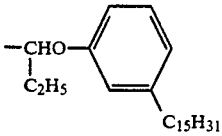 |
| C-1-4 | $-C_2H_5$ | $-Cl$ | 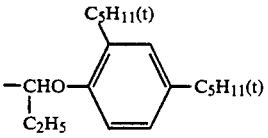 |
| C-1-5 | $-C_4H_9$ | $-F$ | 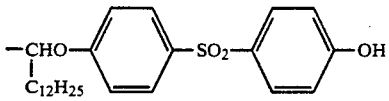 |
| C-1-6 | $-C_2H_5$ | $-F$ | 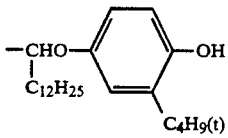 |
| C-1-7 | $-C_2H_5$ | $-Cl$ | 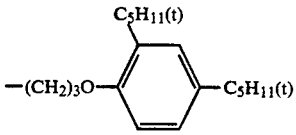 |
| C-1-8 | $-C_2H_5$ | $-Cl$ | 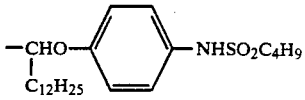 |

-continued
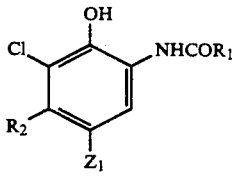
| Coupler No. | $R_2$ | $Z_1$ | $R_1$ |
|---|---|---|---|
| C-1-9 | $-C_2H_5$ | $-Cl$ | 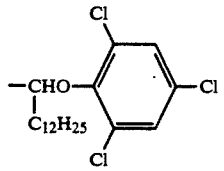 |
| C-1-10 | $-C_6H_{13}$ | $-Cl$ | 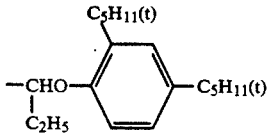 |
| C-1-11 | $-C_3H_7$ | $-Cl$ | 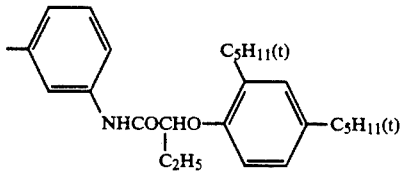 |
| C-1-12 | $-(CH_2)_2-NHCOCH_3$ | $-Cl$ | 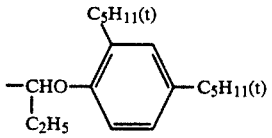 |
| C-1-13 | $-(CH_2)_2OCH_3$ | $-Cl$ | 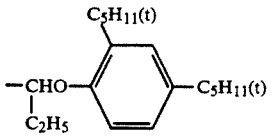 |
| C-1-14 | $-C_2H_5$ | $-Cl$ | 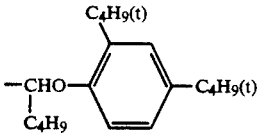 |
| C-1-15 | $-C_4H_9(t)$ | $-O(CH_2)_2-SO_2CH_3$ | 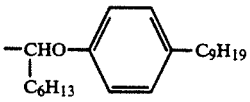 |
| C-1-16 | $-C_2H_5$ | $-Cl$ | 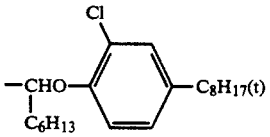 |
| C-1-17 | $-C_2H_5$ | $-Cl$ | 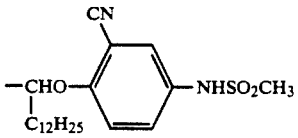 |

-continued

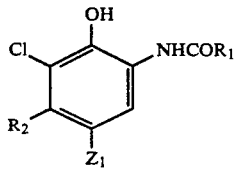

| Coupler No. | $R_2$ | $Z_1$ | $R_1$ |
|---|---|---|---|
| C-1-18 | $-C_2H_5$ | $-Cl$ | 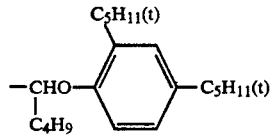  |
| C-1-19 | $-C_2H_5$ | $-Cl$ | $-C_{15}H_{31}(n)$ |

Including the above-mentioned couplers, practical examples of cyan couplers capable of being used in the present invention are described in Japanese Patent Publication No. 11572/1965, Japanese Patent O.P.I. Publication Nos. 3142/1986, 9652/1986, 9653/1986, 39045/1986, 50136/1986, 99141/1986 and 105545/1986.

A cyan dye forming coupler illustrated by the above-mentioned formula [C-1] can be used in the range of $1\times10^{-3}$ to 1 mol, preferably $1\times10^{-2}$ to $8\times10^{-1}$ mol per mol of silver halide normally.

In silver halide photographic light-sensitive materials used in the present invention, various conventional additives for photographic use can be contained. Examples of them include U-V absorbers (for example, benzophenone compounds and benzotriazole compound), dye image stabilizers (for example, phenol compounds, bisphenol compounds, hydroxychromane compounds, spirobichromane compounds, hydantoin compounds, and dialkoxybenzene compounds), anti-stain compounds (such as hydroquinone derivatives), surfactants (such as sodium alkyl naphthalane sulfonic acid, sodium alkylbenzene sulfonic acid, sodium alkyl succinic acid ester sulfonic acid and polyalkylene glycol), water-soluble anti-irradiation dyes (for example, azo type compounds, stylyl type compounds, triphenyl methane type compounds, oxonol type compounds and antraquinone type compounds), hardeners (for example, halogeno-s-triazine type compounds, vinyl sulfon type compound, acryloyl type compound, ethyleneimine type compound, N-methylol type compounds, epoxy type compounds and water-soluble aluminum salts), plasticizers and lubricants (for example, glycerol, fatty group polyalcohols, copolymer dispersants (latex), solid or liquid paraffin and colloid silicas), optical brightening agents (for example, diaminostylbene type compounds) and various oil-soluble paints.

As photographic layers constituting silver halide photographic light-sensitive materials in the present invention, in addition to each emulsion layer, subbing layers, intermediate layers, yellow-filter layer, UV absorbing layers, protective layers and anti-halation layers can be provided at discretion.

As hydrophilic binders used for silver halide photographic light-sensitive materials in the present invention, gelatin is preferable. In addition, gelatin derivatives, graft polymer of gelatin and other polymer, proteins, sugar derivatives, cellulose derivatives and hydrophilic colloids including synthetic hydrophilic polymers such as monopolymers or copolymers may be used.

The total weight of hydrophilic binders is preferable to be not more than 7.8 g/m$^2$.

As a method for adding hydrophobic compounds useful for photographic compounds such as the above-mentioned dye forming compounds and image stabilizers to silver halide photographic light-sensitive materials, various method can be used including a solid dispersion method, latex dispersion method and oil-in-water emulsification dispersion method. They can be selected at discretion according to the chemical structure of hydrophobic compounds.

The oil-in-water emulsification can be applied to various method which disperses hydrophobic compounds. Normally, a low boiling and/or a water-soluble organic solvent is dissolved in a high boiling organic solvent having a boiling point of not less than 150 ° C., and then, the solution is mixed up with an aqueous gelatin solution containing a surfactant by means of a dispersion means such as a stirrer, a homogenizer, a colloid mill, a flow jet mixer or a supersonic apparatus. After emulfication dispersion, the solution may be added to an aimed hydrophilic colloidal layer. A process to remove, together with a dispersed solution or concurrently with dispersion, a low boiling organic solvent can be added.

It is preferable in particular that the weight ratio of oil-phase components composed of hydrophobic compound and a high boiling solvent dissolving the hydrophobic compound and a hydrophilic binder (hereinafter referred to as O/B) is not more than 0.8.

An oil-phase component contained in the present invention means as follows. It is dissolved in an organic solvent according to the above-mentioned addition method and contained therein. In photographic constitution layer, it exists in the status of so-called oil-drop. The oil-drop may sometimes contain hydrophobic compounds such as dye forming compounds, image stabilizers, anti-stain agents and UV absorbers. In this case, the total weight of oil-drops in the present invention means the total weight including the weight of organic solvent and above-mentioned hydrophobic compounds. Besides, when other oil-drop exists (for example, when only a organic solvent exists without containing a hydrophobic photographic-useful compound or when an oil-drop wherein different hydropholic compounds are dissolved in an organic solvent is existing, or when a hydrophobic compound such as an oily UV absorber exists as a oil-drop without being dissolved in an organic solvent at room temperature), the accumulated total weight of oil-drops means the total weight of oil-phase component in the present invention.

As a support of the silver halide photographic light-sensitive materials in the present invention, a support such as paper, glass, cellulose acetate, cellulose nitrate, polyester, polyamide and polystyrene, or stratified materials of 2 or more subtrata such as a laminated material of paper and polyolefin (for example, polyethylene and polypropyrene) can be used at discretion according to the purpose.

For such supports, various surface treatments are provided normally in order to improve adhesivity for silver halide emulsion layers, for example, surface-roughing by means of mechanical treatment or appropriate organic solvents, electron impact treatment, flame treatment and subbing treatment.

EXAMPLE

Next, the examples of the present invention will be given below so that the present invention may be further detailed. It is, however, to be understood that the embodiments of the present invention shall not be limited thereto.

EXAMPLE 1

On a paper support laminated with polyethylene on one surface thereof and laminated with polyethylene containing titanium oxide in an amount shown in Table-1 on the other surface thereof, each layer having the following constitution is coated on the side of the polyethylene layer containing titanium oxide, to prepare multi-layer silver halide color photographic light-sensitive materials 1 through 4. The coated solutions were prepared as follows:

Coating solution for the first layer:

To 26.7 g of yellow coupler (Y-1), 10.0 g of a dye image stabilizer (ST-1), 6.67 g of a dye image stabilizer (ST-2), 0.67 g of an additive (HQ-1) and 6.67 g of a high boiling organic solvent (DNP), 60 ml of ethyl acetate was added to be dissolved. The solution was mixed up with 220 ml of 10% aqueous gelatin containing 7 ml of 20% surfactant (SU-1), and then, the mixture was so emulsified as to be dispersed by means of ultrasonic homogenizer for the preparation of yellow coupler dispersant. This dispersant was mixed with the blue sensitive silver halide emulsion (containing 10 g of silver) prepared under the following conditions for the preparation the first layer coating solution.

The coating solutions for the second layer through seventh layer were prepared in the same manner as that for the above-mentioned first layer.

In addition, as hardeners, (H-1) was added to the second layer and the fourth layer and (H-2) was added to the seventh layer. As coating aids, surfactants (SU-2) and (SU-3) were added, and the surface tension was adjusted.

| Layer | Constitution | Added amount ($g/m^2$) |
|---|---|---|
| Seventh Layer (Protective layer) | Gelatin | 1.20 |
| | Anti-stain agent HQ-2 | 0.002 |
| | Anti-stain agent HQ-3 | 0.002 |
| | Anti-stain agent HQ-4 | 0.004 |
| | Anti-stain agent HQ-5 | 0.02 |
| | DIDP | 0.01 |
| | Anti-fungal agent (F-1) | 0.002 |
| Sixth Layer (UV-absorption layer) | Gelatin | 0.60 |
| | UV-absorber (UV-1) | 0.10 |
| | UV-absorber (UV-2) | 0.04 |
| | UV-absorber (UV-3) | 0.16 |
| | Anti-stain agent (HQ-5) | 0.04 |
| | DNP | 0.45 |
| | PVP | 0.03 |
| | Anti-irradiation dye (AI-2) | 0.02 |
| | Anti-irradiation dye (AI-4) | 0.01 |
| Fifth Layer (Red-sensitive layer) | Gelatin | 1.30 |
| | Red sensitive silver chlorobromide emulsion (Em-R) | 0.21 |
| | Cyan coupler (C-1) | 0.17 |
| | Cyan coupler (C-2) | 0.25 |
| | Dye image stabilizer (ST-1) | 0.20 |
| | Anti-stain agent (HQ-1) | 0.01 |
| | HBS-1 | 0.40 |
| | DOP | 0.40 |
| Fourth Layer (UV-absorption layer) | Gelatin | 1.10 |
| | UV-absorber (UV-1) | 0.28 |
| | UV-absorber (UV-2) | 0.09 |
| | UV-absorber (UV-3) | 0.38 |
| | Anti-stain agent (HQ-5) | 0.10 |
| | DNP | 0.80 |
| Third Layer (Green-sensitive layer) | Gelatin | 1.40 |
| | Green-sensitive silver chlorobromide emulsion (Em-G) | 0.30 |
| | Magenta coupler (M-1) | 0.23 |
| | Dye image stabilizer (ST-3) | 0.20 |
| | Dye image stabilizer (ST-4) | 0.17 |
| | DIDP | 0.13 |
| | DBP | 0.35 |
| | Anti-irradiation dye (AI-1) | 0.01 |
| Second Layer (Intermediate layer) | Gelatin | 1.30 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.20 |
| | Anti-fungal agent | 0.002 |
| First Layer (Blue-sensitive layer) | Gelatin | 1.20 |
| | Blue sensitive silver chlorobromide emulsion (Em-B) | 0.26 |
| | Yellow coupler (Y-1) | 0.80 |
| | Dye image stabilizer (ST-1) | 0.30 |
| | Dye image stabilizer (ST-2) | 0.20 |
| | Anti-stain agent (HQ-1) | 0.02 |
| | Anti-irradiation dye (AI-3) | 0.01 |
| | DNP | 0.40 |
| Support | Polyethylene-laminated paper | |

The added amount of silver halide emulsion is shown after being converted to silver.

Y-1
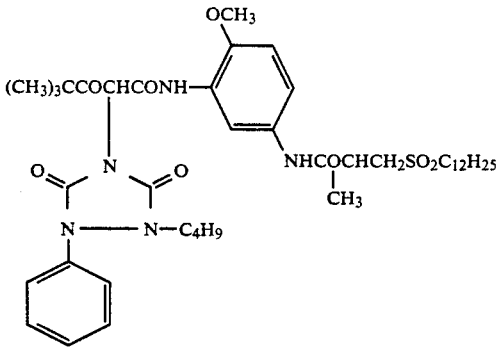
M-1
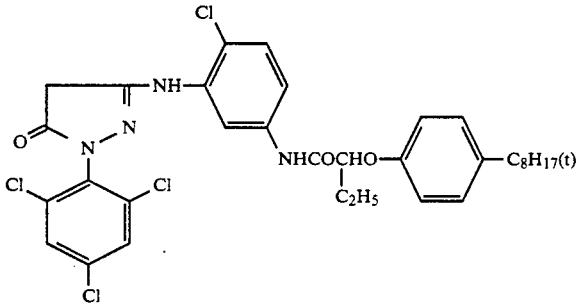
C-1
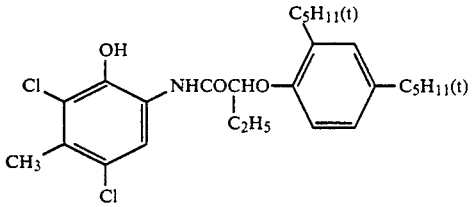
C-2
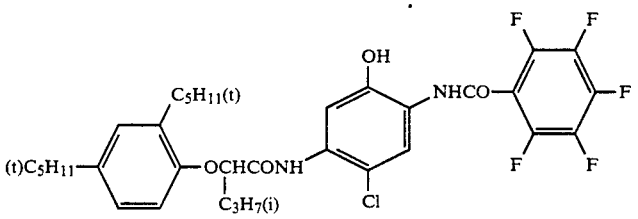
ST-1
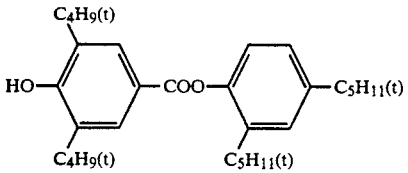
ST-2
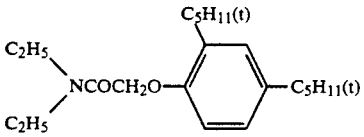
ST-3
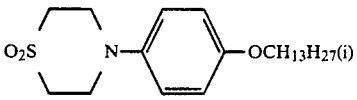

-continued
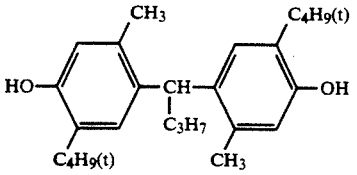
ST-4
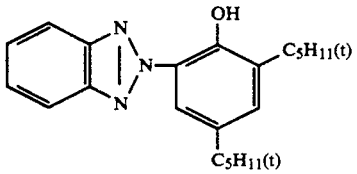
UV-1
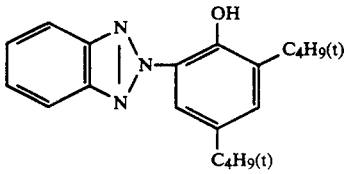
UV-2
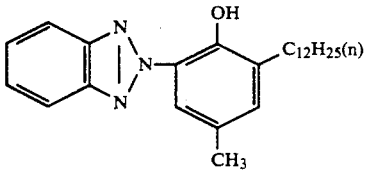
UV-3
| | |
|---|---|
| Dibutyl Phthalate | DBP |
| Dioctyl Phthalate | DOP |
| Dinonyl Phthalate | DNP |
| Diisodecyl Phthalate | DIDP |
| Poly(vinylpyrrolidone) | PVP |
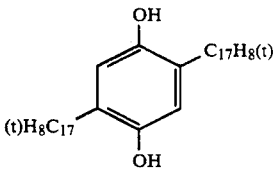
HQ-1
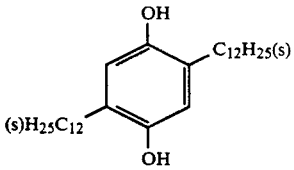
HQ-2
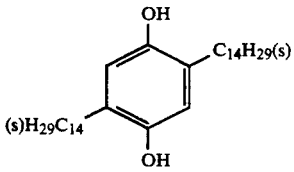
HQ-3
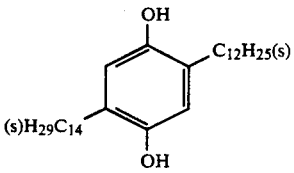
HQ-4

-continued
HQ-5
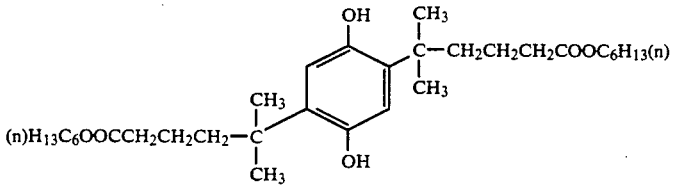
HBS-1
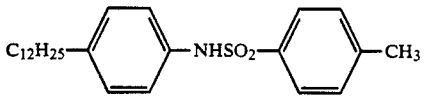
AI-1
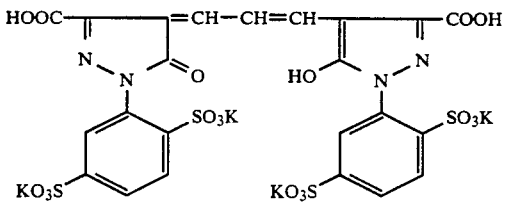
AI-2
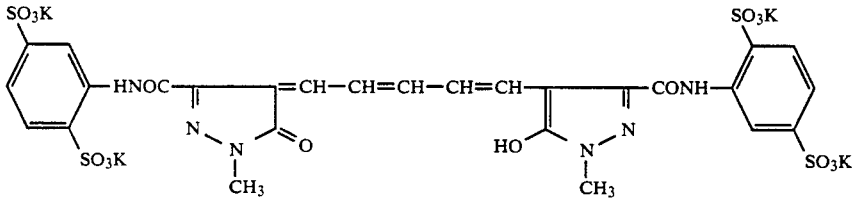
AI-3
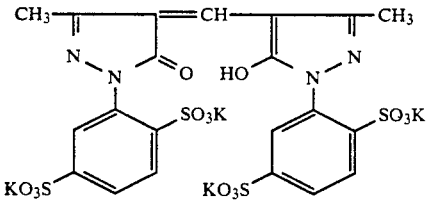
AI-4
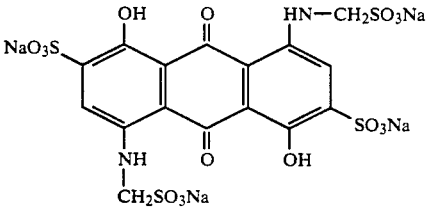
SU-1
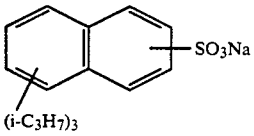
SU-2
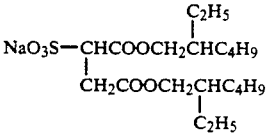
SU-3
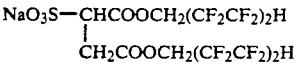
H-1
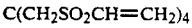

-continued

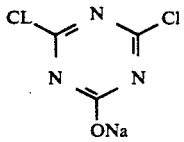

H-2

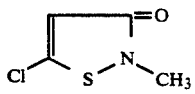

F-1

(Preparation of blue sensitive silver halide emulsion)

To 1,000 ml of 2% gelatin aqueous solution kept at 40° C., the following Solution A and Solution B were added simultaneously over a period of 30 minutes while controlling the solution at pAg=65 and pH=3.0. In addition, the following Solution C and Solution D were added simultaneously spending 180 minutes while controlling the solution at pAg=7.3 and pH=5.5. At this time, pAg was controlled by a method described in Japanese Patent O.P.I. Publication No. 45437/1984 and pH was controlled by employing aqueous solution of sulfuric acid or sodium hydroxide.

| | |
|---|---|
| (Solution A) | |
| Sodium chloride | 3.42 g |
| Potassium bromide | 0.03 g |
| Add water to make 200 ml. | |
| (Solution B) | |
| Silver nitrate | 10 g |
| Add water to make 200 ml. | |
| (Solution C) | |
| Sodium chloride | 102.7 g |
| Potassium bromide | 1.0 g |
| Add water to make 600 ml. | |
| (Solution D) | |
| Silver nitrate | 300 g |
| Add water to make 600 ml. | |

After addition was completed, the solution was desalted using 5% aqueous solution of Demol N manufactured by Kao Atlas and 20% aqueous solution of magnesium sulfate. Then, the solution was mixed with gelatin aqueous solution. Thus, a mono-dispersed cubic emulsion EMP-1 having an average grain size of 0.85 μm, a variation coefficient (σ/r)=0.07 and a silver chloride-containing rate of 99.5 mol % was obtained.

The above-mentioned emulsion EMP-1 was subjected to chemical ripening using the following compounds for 90 minutes at 50° C. Thus, a blue sensitive silver halide emulsion (Em-B) was obtained.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Stabilizer STAB-2 | $2 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

(Preparation of green sensitive silver halide emulsion)

In the same manner as in EMP-1 except that the period of time for adding Solution A and Solution B and that for adding Solution C and Solution D were changed, a mono-dispersed cubic emulsion EMP-2 having an average grain size of 0.43 μm, a variation coefficient (o/r)=0.08 and a silver chloride-containing rate of 99.5 mol % was obtained.

EMP-2 was subjected to chemical ripening employing the following chemicals for 120 minutes at 55 ° C. Thus, a green-sensitive silver halide emulsion Em-G was obtained.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

(Preparation of red-sensitive silver halide emulsion)

In the same manner as in EMP-1 except that the period of time for adding Solution A and Solution B and that for adding Solution C and Solution D were changed, a mono-dispersed cubic emulsion EMP-3 having an average grain size of 0.50 μm, a variation coefficient (o/r)=0.08 and a silver chloride-containing rate of 99.5 mol % was obtained.

EMP-3 was subjected to chemical ripening employing the following chemicals for 90 minutes at 60° C. Thus, a red-sensitive silver halide emulsion Em-R was obtained.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $1 \times 10^{-4}$ mol/mol AgX |

BS-1

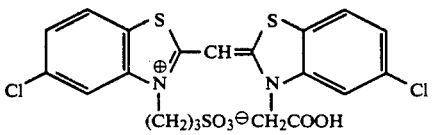

BS-2

-continued

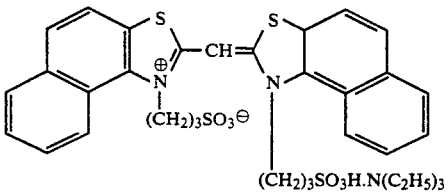

GS-1

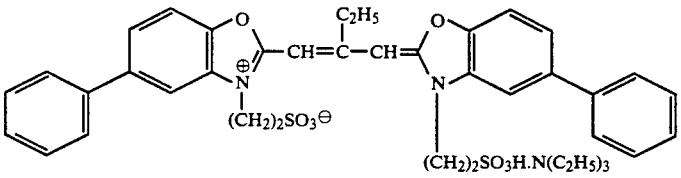

RS-1

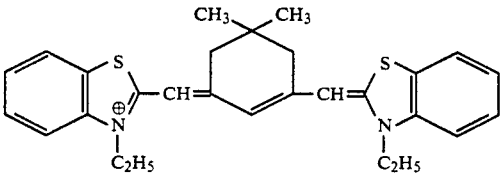

STAB-1

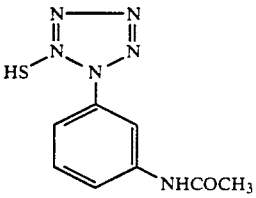

STAB-2

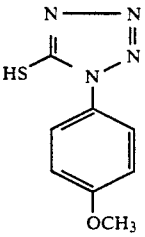

The amount of titanium oxide contained in polyethylene support is shown in Table 1. In addition, as shown below, Sample 5 wherein the amount of gelatin was changed and O/B was adjusted was prepared. Here, when O/B was adjusted, high boiling solvent of each layer was reduced in the same ratio (DNP, DBP, DOP, DIDP and HBS-1).

| Layer | Gelatin (g/m$^2$) |
|---|---|
| Seventh layer | 1.20 → 1.00 |
| Sixth layer | 0.60 → 0.40 |
| Fourth layer | 1.10 → 0.95 |
| Second layer | 1.30 → 1.20 |

The obtained light-sensitive materials 1 to 5 were exposed to light according to a conventional method. Then, they were subjected to running processing under the following processing conditions A, B, C and D.

| | (Processing condition A) | | |
|---|---|---|---|
| Processing step | Temperature | Time | Replenishing rate |
| (1) Color developing | 35.0 ± 0.3° C. | 45 seconds | 160 ml |
| (2) Bleach fixing | 35.0 ± 0.5° C. | 60 seconds | 160 ml |
| (3) Stabilizing (3 tank cascade) | 30–34° C. | 90 seconds | 240 ml |
| (4) Drying | 60–80° C. | 30 seconds | |

The replenishing rate represents a value per 1 m$^2$ of the photographic material.

| Color-developing tank solution | |
|---|---|
| Triethanolamine | 10 g |
| Diethylene glycol | 5 g |
| N, N-diethylhydroxylamine | 5.0 g |
| Potassium bromide | 0.02 g |
| Potassium chloride | 2 g |
| Diethylenetriamine penta-acetic acid | 5 g |

-continued

| Color-developing tank solution | |
|---|---|
| Potassium sulfite | 0.2 g |
| Color developer (3-methyl-4-amino-N-ethyl-N-(β-methanesulfonamidoethyl)-aniline sulfate) | 5.2 g |
| Potassium carbonate | 25 g |
| Potassium hydrocarbonate | 5 g |

Water was added to make 1 liter, and pH was adjusted to 10.10 with potassium hydroxide or sulfate.

| Replenisher for color developer | |
|---|---|
| Triethanolamine | 14.0 g |
| Diethyleneglycol | 8.0 g |
| N,N-diethylhydroxylamine | 6.0 g |
| Potassium chloride | 1.3 g |
| Diethylenetriamine penta-acetic acid | 7.5 g |
| Potassium sulfite | 0.3 g |
| Color developer (3-methyl-4-amino-N-ethyl-N-(β-methanesulfoneamide ethyl)-aniline sulfate | 7.8 g |
| Potassium carbonate | 30 g |
| Potassium hydrocarbonate | 1 g |

Water was added to make 1 liter, and pH was adjusted to 10.60 with potassium hydroxide or sulfuric acid.

| Bleach fixer tank solution and its replenisher | |
|---|---|
| Ethylenediamine tetraacetic acid ferric ammonium salt | 100 g |
| Tetraacetate ethylenediamine | 3.0 g |
| Ammonium thiosulfate (70% solution) | 150 g |
| Ammonium sulfurous acid (40% solution) | 51.0 g |

Water was added to make 1 liter while to adjusting pH to 6.0 with aqueous ammonia or glacial acetic acid.

| Stabilizer tank solution and its replenisher | |
|---|---|
| Ortho-phenyl phenol | 0.2 g |
| Ubitex CK (produced by Chiba Geigy) | 1.0 g |
| $ZnSO_4$ | 0.5 g |
| Ammonium sulfite (40% solution) | 5.0 ml |
| 1-hydroxyethylidene-1,1-diphosphnic acid (60% solution) | 5.0 g |
| Ethylenediamine tetraacetic acid | 1.5 g |
| Benzoisothiazoline-3-on | 0.2 g |

Water was added to make 1 l, while adjusting pH to 7.8 with aqueous ammonia or sulfuric acid.

| | Temperature | Processing time | Replenishing rate (ml/m$^2$) |
|---|---|---|---|
| (Processing condition B) | | | |
| (1) Color developing | 35 ° C. | 45 seconds | 61 |
| (2) Bleaching | 38 ° C. | 20 seconds | 30 |
| (3) Fixing | 38 ° C. | 20 seconds | 30 |
| (4) Stabilizing* | 30 ° C. | 40 seconds | 101 |
| (5) Drying | 60–80 ° C. | 30 seconds | — |

| Tank solution of color developer | |
|---|---|
| Diethyleneglycol | 15 g |
| Potassium bromide | 0.02 g |
| Potassium chloride | 2.0 g |
| Potassium sulfite (50% solution) | 0.5 ml |
| Color developer (3-methyl-4-amino-N-ethyl-N-(β-methanesulfonamideethyl)-aniline sulfate | 6 g |
| Diethylhydroxylamine (85%) | 5 g |
| Triehtanolamine | 10 g |
| Potassium carbonate | 30 g |

-continued

| | |
|---|---|
| Ethylenediamine tetraacetic acid | 2 g |
| Brightening agent (produced by Nisso, PK-Conc) | 2 g |

*The stabilizing tank is a 3-tank cascade.

Add water to make 1 l, and adjust pH to 10.15 with potassium hydroxide or sulfuric acid.

| Replenisher for color developer | |
|---|---|
| Diethyleneglycol | 17 g |
| Potassium chloride | 3 g |
| Potassium sulfite (50% solution) | 1.0 ml |
| Color developer (3-methyl-4-amino-N-ethyl-N-(β-methanesulfoneamideethyl)-aniline sulfate) | 8.8 g |
| Diethylhydroxylamine (85%) | 7 g |
| Triethanolamine | 10 g |
| Potassium carbonate | 30 g |
| Ethylenediamine tetraacetic acid | 2 g |
| Brightening agent (produced by Nisso, PK-Conc) | 2.5 g |

Add water to make 1 l, and adjust pH to 11.0 with potassim hydroxide or sulfuric acid.

| Bleaching and fixing tank solution | |
|---|---|
| Organic acid ferric sodium salt (A-1) | 100 g |
| Ethylenediamine tetraacetatic acid | 2 g |
| Ammonium bromide | 178 g |
| Glacial acetic acid | 50 ml |

Water was added to make 1 liter, and pH was adjusted at discretion to the value shown in Table 1 using aqueous ammonium or glacial acetic acid.

| Replenisher for bleaching solution | |
|---|---|
| Organic acid ferric sodium salt (A-1) | 120 g |
| Ethylenediamine tetraacetatic acid | 2 g |
| Ammonium bromide | 178 g |
| Glacial acetic acid | 50 ml |

Water was added to make 1 liter, and pH was adjusted at discretion to the value shown in Table 1 using aqueous ammonium or glacial acetic acid.

| Fixing tank solution and replenisher of fixing solution | |
|---|---|
| Ammonium thiosulfate | 180 g |
| Ammonium thiocyanate | 120 g |
| Sodium metabisulfite | 3 g |
| Ethylenediamine tetraacetatic acid | 0.8 g |

Water was added to make 1 l, and pH was adjusted to 6.5 with acetic acid and aqueuos ammonium.

| Tank solution of stabilizer and replenisher for stabilizer | |
|---|---|
| Orthophenylphenol | 0.15 g |
| $ZnSO_4.7H_2O$ | 0.2 g |
| Ammonium sulfite (40% solution) | 5.0 ml |
| 1-hydroxyethylidene-1,1-diphosphnic acid (60% solution) | 2.5 g |
| Ethylenediamine tetraacetic acid | 2.0 g |
| Brightening agent (Tinopal SFP produced by Ciba Geigy) | 2.0 g |

Water was added to make 1 l while adjusting pH to 7.8 with aqueous ammonium or sulfuric acid.

(Processing condition C)

The processing conditions were the same as the processing condition A except that the temperature of color developer was 38° C. and the developing time was 20 seconds.

(Processing condition D)

The processing conditions were the same as the processing condition B except that the temperature of color developer was 38° C. and the developing time was 20 seconds.

Evaluation of Sharpness

Each sample was exposed to test charts for resolving power using blue light, green light and red light. After they were processed according to the above-mentioned processing steps, the densities of the obtained yellow image, magenta image and cyan image were measured with a microphotometer. The values represented by the following formula are defined to be sharpness.

$$\text{Sharpness (\%)} = \frac{\text{(maximum density} - \text{minimum density) of 5 lines/mm printed line image}}{\text{(maximum density} - \text{minimum density) on large area portion}} \times 100$$

The larger the value is, the more excellent the sharpness is.

Evaluation of the Quality of Layer Surface

Samples were subjected to overall exposure to light so that the density of magenta which gives the most important influence may evenly be 1.0. After developing and processing, the layer surface of the processed samples were subjected to visual check and the occurrence of unevenness was evaluated. We evaluated them by 5 grades, i.e. from (1) extremely superior to (5) extremely inferior. The results are shown in Table 1.

TABLE 1

| Sample No. | Content amount of TiO ($g/m^2$) | Content amount of gelatin ($g/m^2$) | O/B | Processing Step | Sharpness B | Sharpness G | Sharpness R | Quality of layer surface | Remarks |
|---|---|---|---|---|---|---|---|---|---|
| 1 | 2.7 | 8.1 | 0.88 | A | 0.50 | 0.51 | 0.50 | 2.25 | Comparative |
| 1 | 2.7 | 8.1 | 0.88 | B | 0.50 | 0.50 | 0.50 | 2 | Comparative |
| 2 | 3.2 | 8.1 | 0.88 | A | 0.54 | 0.55 | 0.55 | 2.5 | Comparative |
| 2 | 3.2 | 8.1 | 0.88 | B | 0.54 | 0.56 | 0.55 | 2.25 | Comparative |
| 3 | 3.7 | 8.1 | 0.88 | A | 0.62 | 0.66 | 0.65 | 3.25 | Comparative |
| 3 | 3.7 | 8.1 | 0.88 | B | 0.62 | 0.67 | 0.65 | 2.5 | Invention |
| 4 | 4.1 | 8.1 | 0.88 | B | 0.67 | 0.71 | 0.70 | 2.5 | Invention |
| 5 | 3.7 | 7.5 | 0.72 | B | 0.64 | 0.69 | 0.68 | 2.25 | Invention |
| 5 | 3.7 | 7.5 | 0.72 | C | 0.64 | 0.68 | 0.68 | 3.5 | Comparative |
| 5 | 3.7 | 7.5 | 0.72 | D | 0.64 | 0.69 | 0.67 | 2.25 | Invention |

From the results shown in Table 1, the following matters can be concluded.

1. When the content of titanium oxide is larger, the sharpness is improved, but the quality of layer surface is degraded. By processing samples according to the processing condition of the present invention, the quality of layer surface can be improved without degrading the sharpness.
2. By reducing the amount of gelatin and decreasing O/B value as well, the present invention becomes more effective.
3. When the time for developing and processing is shorted, the effect of the present invention is enhanced.

EXAMPLE 2

On a triacetyl cellulose film support, layers each having the following compositions were formed in this order from the support side, and thus a multi-layer color photographic light-sensitive material was prepared.

| (Light-sensitive material samples) | |
|---|---|
| First layer; Anti-halation layer | |
| Black colloidal silver | 0.2 |
| UV absorber (UV-5) | 0.23 |
| High boiling solvent (Oil-1) | 0.18 |
| Gelatin | 1.4 |
| Second layer; First intermediate layer | |
| Gelatin | 1.3 |
| Third layer; Low speed red-sensitive emulsion layer | |
| Silver iodobromide emulsion (average grain size is 0.4 μm and AgI 2.0 mol %) | 1.0 |
| Sensitizing dye (SD-1) | $1.8 \times 10^{-5}$ (mol/mol of silver) |
| Sensitizing dye (SD-2) | $2.8 \times 10^{-4}$ (mol/mol of silver) |
| Sensitizing dye (SD-3) | $3.0 \times 10^{-4}$ (mol/mol of silver) |
| Cyan coupler (C-6) | 0.70 |
| Colored cyan coupler (CC-1) | 0.066 |
| DIR compound (D-1 | 0.03 |
| DIR compound (D-3) | 0.01 |
| High boiling solvent (Oil-1) | 0.64 |
| Gelatin | 1.2 |
| Fourth layer; Medium speed red-sensitive emulsion layer | |
| Silver iodobromide emulsion (average grain size 0.7 μm, AgI 8.0 mol %) | 0.8 |
| Sensitizing dye (SD-1) | $2.1 \times 10^{-5}$ (mol/mol of silver) |
| Sensitizing dye (SD-2) | $1.9 \times 10^{-4}$ (mol/mol of silver) |
| Sensitizing dye (SD-3) | $1.9 \times 10^{-4}$ (mol/mol of silver) |
| Cyan coupler (C-6) | 0.28 |
| Colored cyan coupler (CC-1) | 0.027 |
| DIR compound (D-1) | 0.01 |
| High boiling solvent (Oil-1) | 0.26 |
| Gelatin | 0.6 |
| Fifth layer; High speed red-sensitive emulsion layer | |
| Silver iodobromide emulsion (average grain size 0.8 μm and AgI 8.0 mol %) | 1.70 |
| Sensitizing dye (SD-1) | $1.9 \times 10^{-5}$ (mol/mol of silver) |
| Sensitizing dye (SD-2) | $1.7 \times 10^{-4}$ (mol/mol of silver) |
| Sensitizing dye (SD-3) | $1.7 \times 10^{-4}$ (mol/mol of silver) |
| Cyan coupler (C-6) | 0.05 |
| Cyan coupler (C-7) | 0.10 |
| Colored cyan coupler (CC-1) | 0.02 |
| DIR compound (D-1) | 0.025 |
| High boiling solvent (Oil-1) | 0.17 |
| Gelatin | 1.2 |
| Sixth layer; Second intermediate layer | |
| Gelatin | 0.8 |
| Seventh layer; Low speed green sensitive emulsion layer | |
| Silver iodobromide emulsion (average grain size 0.4 μm and AgI 2.0 mol %) | 1.1 |
| Sensitizing dye (SD-4) | $6.8 \times 10^{-5}$ (mol/mol of silver) |
| Sensitizing dye (SD-5) | $6.2 \times 10^{-4}$ (mol/mol of silver) |
| Magenta coupler (M-5) | 0.54 |
| Magenta coupler (M-6) | 0.19 |
| Colored magenta coupler (CM-1) | 0.06 |
| DIR compound (D-2) | 0.017 |
| DIR compound (D-3) | 0.01 |
| High boiling solvent (Oil-2) | 0.81 |

-continued

| (Light-sensitive material samples) | |
|---|---|
| Gelatin | 1.8 |
| Eighth layer; Medium speed green sensitive emulsion layer | |
| Silver iodobromide emulsion (average grain size 0.7 μm and AgI 8.0 mol %) | 0.70 |
| Sensitizing dye (SD-6) | $1.9 \times 10^{-4}$ (mol/mol of silver) |
| Sensitizing dye (SD-7) | $1.2 \times 10^{-4}$ (mol/mol of silver) |
| Sensitizing dye (SD-8) | $1.5 \times 10^{-5}$ (mol/mol of silver) |
| Magenta coupler (M-5) | 0.07 |
| Magenta coupler (M-6) | 0.03 |
| Colored magenta coupler (CM-1) | 0.04 |
| DIR compound (D-2) | 0.018 |
| High boiling solvent (Oil-2) | 0.30 |
| Gelatin | 0.8 |
| Ninth layer; High speed green sensitive emulsion layer | |
| Silver iodobromide emulsion (average grain size 1.0 μm and AgI 8.0 mol %) | 1.70 |
| Sensitizing dye (SD-6) | $1.2 \times 10^{-4}$ (mol/mol of silver) |
| Sensitizing dye (SD-7) | $1.0 \times 10^{-4}$ (mol/mol of silver) |
| Sensitizing dye (SD-8) | $3.4 \times 10^{-6}$ (mol/mol of silver) |
| Magenta coupler (M-5) | 0.09 |
| Magenta coupler (M-7) | 0.04 |
| Colored magenta coupler (CM-1) | 0.04 |
| High boiling solvent (Oil-2) | 0.31 |
| Gelatin | 1.2 |
| Tenth layer; Yellow filter layer | |
| Yellow colloidal silver | 0.05 |
| Anti-stain agent (SC-1) | 0.1 |
| High boiling solvent (Oil-2) | 0.13 |
| Gelatin | 0.7 |
| Formalin scavenger (HS-1) | 0.09 |
| Formalin scavenger (HS-2) | 0.07 |
| Eleventh layer; Low speed blue sensitive emulsion layer | |
| Silver iodobromide emulsion (average grain size 0.4 μm and AgI 2.0 mol %) | 0.5 |
| Silver iodobromide emulsion (average grain size 0.7 μm) (average grain size 0.7 μm and AgI 8.0 mol %) | 0.5 |
| Sensitizing dye (SD-9) | $5.2 \times 10^{-4}$ (mol/mol of silver) |
| Sensitizing dye (SD-10) | $1.9 \times 10^{-5}$ (mol/mol of silver) |
| Yellow coupler (Y-3) | 0.65 |
| Yellow coupler (Y-4) | 0.24 |
| DIR compound (D-1) | 0.03 |

-continued

| (Light-sensitive material samples) | |
|---|---|
| High boiling solvent (Oil-2) | 0.18 |
| Gelatin | 1.3 |
| Formalin scavenger (HS-1) | 0.08 |
| Twelfth layer; High speed blue sensitive emulsion layer | |
| Silver iodobromide emulsion (average grain size 1.0 μm and AgI 8.0 mol %) | 1.0 |
| Sensitizing dye (SD-9) | $1.8 \times 10^{-4}$ (mol/mol of silver) |
| Sensitizing dye (SD-10) | $7.9 \times 10^{-5}$ (mol/mol of silver) |
| Yellow coupler (Y-3) | 0.15 |
| Yellow coupler (Y-4) | 0.05 |
| High boiling solvent (Oil-2) | 0.074 |
| Gelatin | 1.30 |
| Formalin scavenger (HS-1) | 0.05 |
| Formalin scavenger (HS-2) | 0.12 |
| Thirteenth layer; First protective layer | |
| Fine-grain silver iodobromide emulsion (average grain size 0.08 μm and AgI 1 mol %) | 0.4 |
| UV absorber (UV-5) | 0.07 |
| UV absorber (UV-6) | 0.10 |
| High boiling solvent (Oil-1) | 0.07 |
| High boiling solvent (Oil-3) | 0.07 |
| Formalin scavenger (HS-1) | 0.13 |
| Formalin scavenger (HS-2) | 0.37 |
| Gelatin | 1.3 |
| Fourteenth layer; Second protective layer | |
| Alkali-soluble matting agent (average grain size 2 μm) | 0.13 |
| Polymethylmethacrylate (average grain size 3 μm) | 0.02 |
| Slipping agent (WAX-1) | 0.04 |
| Gelatin | 0.6 |

In addition to the above-mentioned compounds, coating aid Su-1, dispersion aid Su-2, viscosity adjustment agent, hardeners H-3 and H-2, stabilizer ST-11, anti-foggant AF-1 and 2 kinds of AF-2 having molecular weight of 10,000 and 1,100,000 were added.

The emulsions used for the above-mentioned sample were prepared in the same manner as in Example 1. Each emulsion was subjected to gold-sulfur sensitization most appropriately. The average grain size is represented by the grain size converted to a cube.

C-6

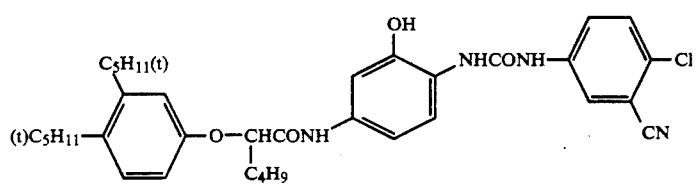

C-7

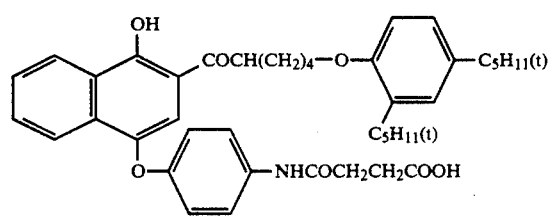

-continued
M-5
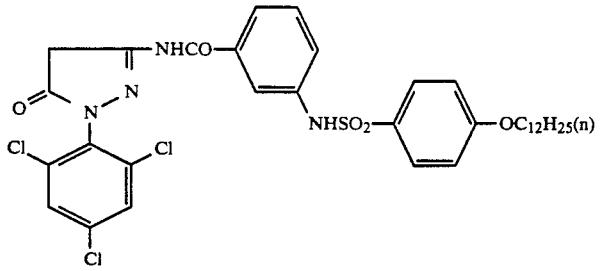
M-6
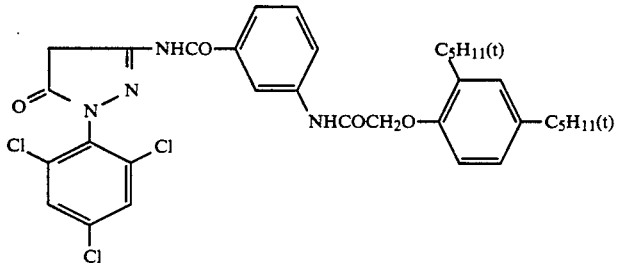
M-7
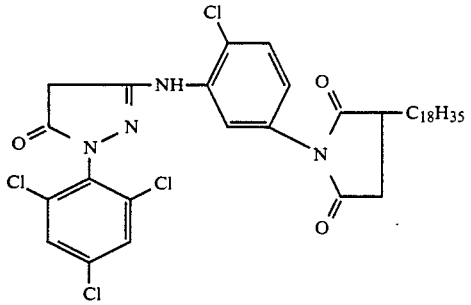
Y-3
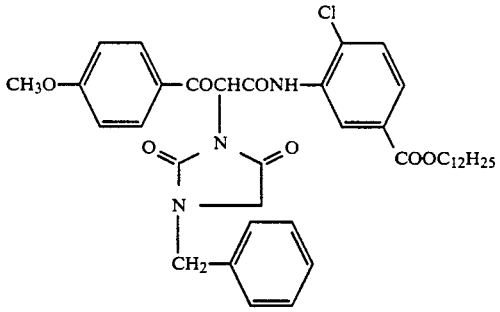
Y-4
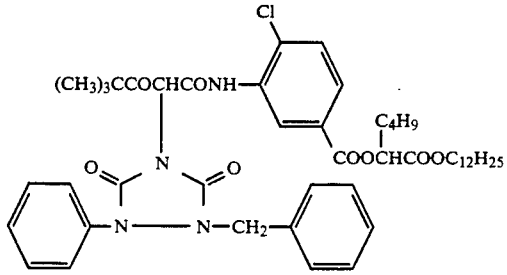

-continued
CC-1
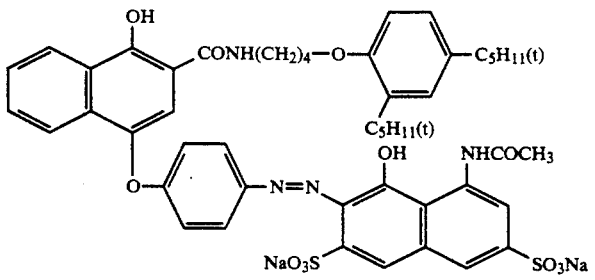
CM-1
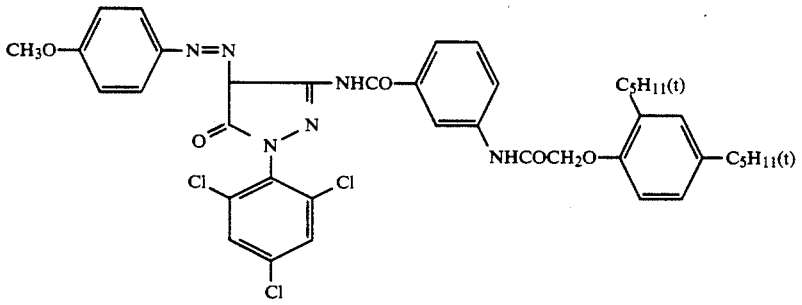
D-1
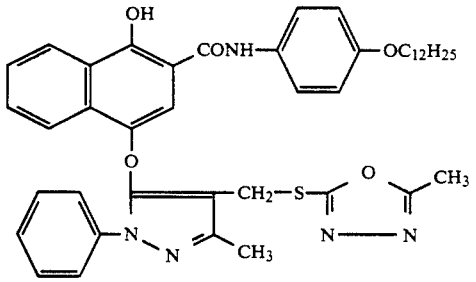
D-2
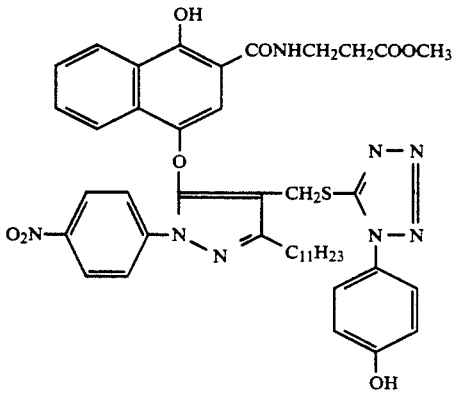

-continued
D-3
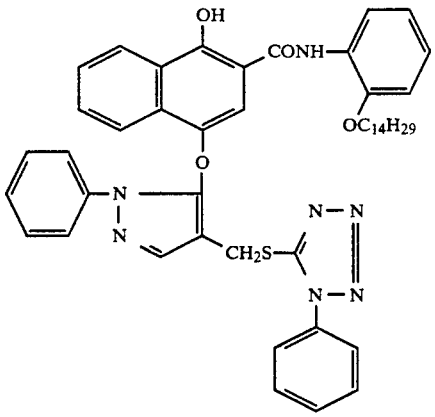
Oil-1
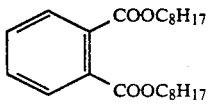
Oil-2
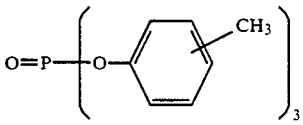
Oil-3
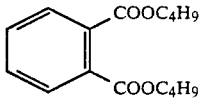
SC-1
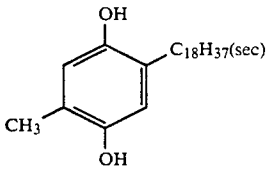
UV-1
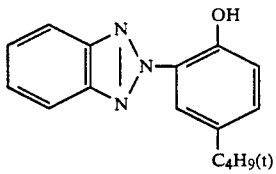
UV-2
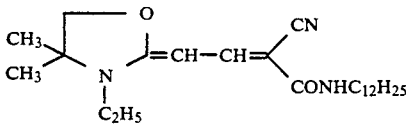
WAX-1
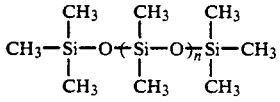
MW = 3,000 (weight-average molecular weight)
Su-1
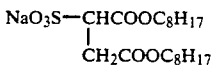

-continued
Su-2
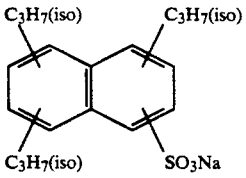
HS-1
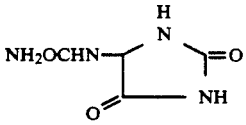
HS-2
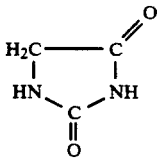
SD-1
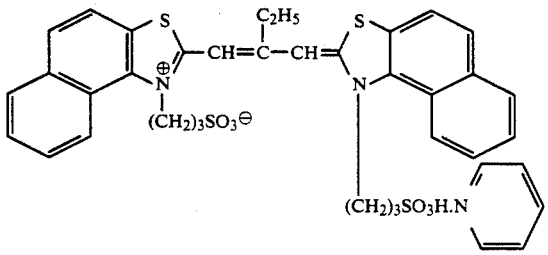
SD-2
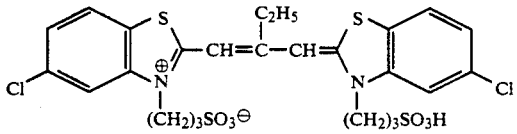
SD-3
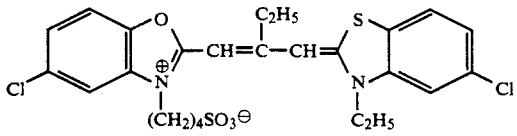
SD-4
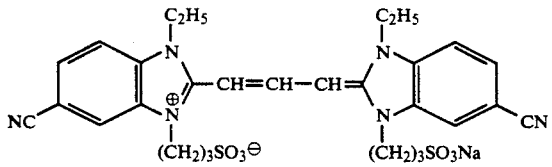
SD-5
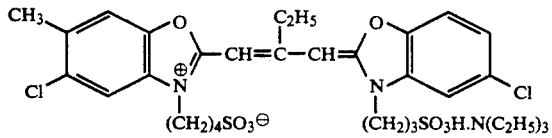
SD-6
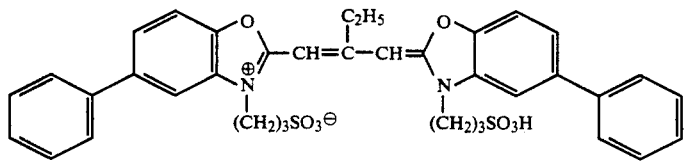

-continued

SD-7

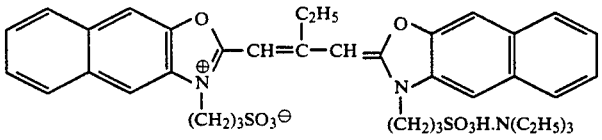

SD-8

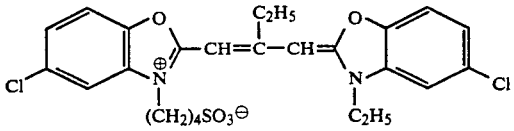

SD-9

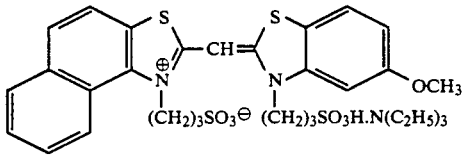

SD-10

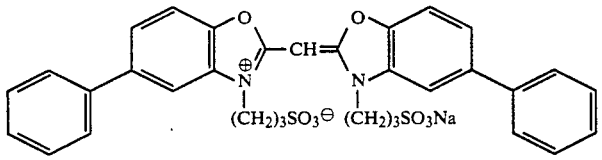

H-2

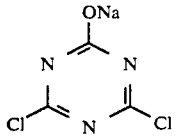

$(CH_2{=}CHSO_2CH_7)_2O$

H-3

ST-11

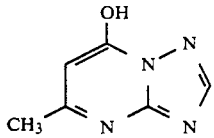

AF-1

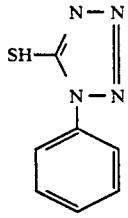

AF-2

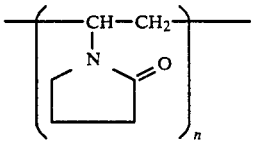

n: (polymerization degree)

The sample thus prepared was subjected to wedge exposure employing white light. Then, it was processed under the following conditions.

| Processing step E | Processing time | Processing temperature | Amount of* replenishing |
|---|---|---|---|
| Color developing | 3 min. and 15 sec. | 38° C. | 536 ml |
| Bleaching | 45 sec. | 38° C. | 134 ml |
| Fixing | 1 min. and 30 sec. | 38° C. | 536 ml |
| Stabilizing** | 90 sec. | 38° C. | 536 ml |

-continued

| Processing step E | Processing time | Processing temperature | Amount of* replenishing |
|---|---|---|---|
| Drying | 1 min. | 40–70° C. | |

*The amount of replenishing represents a value per 1 $m^2$ of light-sensitive material.
**For stabilizing, 3-tank counter-current system was used, and the replenisher was replenished to the final tank of stabilization.

The composition of processing solutions used for the above-mentioned processing steps are as follows:

| Color developer | |
|---|---|
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl) aniline sulfate | 4.5 g |
| Diethylenetriamine pentaacetate | 3.0 g |
| Potassium hydroxide | 1.2 g |

Water was added to make 1 l, and pH was adjusted to 10.06 with potassium hydroxide or 20% sulfuric acid.

| Replenisher for color developer | |
|---|---|
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-amino-3-methyl-N-ethyl-N-(β-hydroxylethyl) aniline sulfate | 5.8 g |
| Potassium hydroxide | 2 g |
| Diethylenetriamine penaacetatic acid | 3.0 g |

Water was added to make 1 l, and pH was adjusted to 10.12 with potassium hydroxide or 20% sulfuric acid.

As a bleaching tank solution, fixing tank solution, stabilizing tank solution and each replenishers thereof, those used in the processing condition B of Example 1 were used.

Simultaneously with the above-mentioned processing step E, the following color paper samples Nos. 6 to 10 were, after exposed to light, processed in the processing steps identical to the processing condition D of Example 1, except that the overflowed solution of the bleaching solution in the above-mentioned processing step E was used as the replenisher of bleaching solution. In the same manner as in Example 1, sharpness and quality of layer surface were evaluated. For the evaluation of the quality of layer surface, samples were exposed uniformly so that the density of yellow, magenta and cyan may be 1.0. Then, they were developed and subjected to visual check.

Experiment 2-1

Processing step A (Color negative film)
Color developer—Bleaching solution—
Fixing solution—Stabilizer Processing step B (Color paper)
Color developer—Bleaching solution—
Fixing solution—Stabilizer In each processing step, replenishers were added respectively. The overflowed solution of the bleaching solution in processing step A was used for running treatment as the replenisher for the processing step B.

Piping was arranged so that the overflowed solution of the bleaching solution for color negative film may enter (be replenished) into the bleaching solution for color paper entirely, and the solution was subjected to running treatment. Running treatment was conducted continuously until the replenishing amount of bleaching solution reached the volume that is twice the tank volume of bleaching solution for color paper (called 2R). With regard to the processed quantity of film and paper, when one roll of color negative film (135 size 24 EX) was processed, 24 prints of color paper E size (8.2 cm ×11.7 cm) were running-processed.

Sample No. 6: It is the same as Sample 5 of Example 1 except that the magenta coupler in the green-sensitive layer (the third layer) of Sample 5 was changed to M-2 and the amount of silver was changed to 0.16 g/$m^2$.

Sample No. 7: It is the same as Sample 6 except that M-2 was replaced with M-3.

Sample No. 8: It is the same as Sample No.6 except that the white pigment contained in the polyethylene layer of the support was changed to a mixture of titanium oxide (8)+zinc oxide (2).

Sample No. 9: It is the same as Sample 6 except that STAB-2 used in manufacturing silver halide emulsion was replaced with STAB-3.

Sample No. 10: A multi-layer color photographic light-sensitive material having the following composition.

M-2

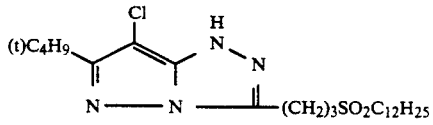

STAB-2

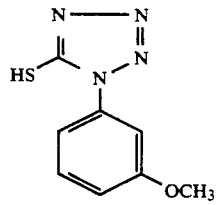

M-3

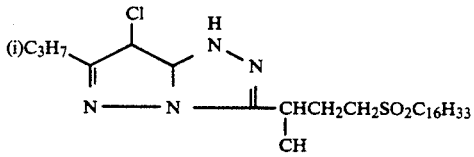

Sample No. 10

On a paper support wherein polyethylene is laminated on one surface thereof and polyethylene containing titanium dioxide is laminated on the other surface thereof, layers having the following constitutions were coated on the side of polyethylene layer containing titanium dioxide, thus a multi-layer silver halide color photographic light-sensitive material was prepared. The coating solution was prepared as follows:

First Layer Coating Solution

At first, 19.1 g of yellow coupler (Y-2), 4.4 g of dye image stabilizer (ST-5), 27.2 cc of ethyl acetate and 7.7 cc of high boiling organic solvent (solv-1) were added to be dissolved. This solution was emulsified and dispersed in 185 cc of 10% aqueous gelatin solution containing 8 cc of 10% sodium dodecylbenzensulfonic acid, thus, yellow coupler dispersion solution was prepared. This dispersion solution was mixed with the blue sensitive silver halide emulsion prepared according to the following conditions to prepare the first layer coating solution.

The coating solutions for the second layer to the seventh layer were prepared in the same manner as the above-mentioned coating solution for the first layer. In addition, H-2 was used for gelatin hardener for each layer.

| Layer | Constitution | Added amount ($g/m^2$) |
|---|---|---|
| Seventh layer (Protective layer) | Gelatin | 1.06 |
| | Acryl-degenerated copolymer of polyvinyl alcohol (degeneration degree, 17%) | 0.17 |
| | Fluid parafin | 0.03 |
| Sixth layer (UV absorber layer) | Gelatin | 0.42 |
| | UV absorber (UV-4) | 0.21 |
| | High boiling organic solvent (solv-3) | 0.08 |
| Fifth layer (Red-sensitive layer) | Gelatin | 1.06 |
| | Red-sensitive silver chlorobromide emulsion (silver chloride content 99.5%) | 0.20 |
| | Cyan coupler (C-1) | 0 07 |
| | Cyan coupler (C-3) | 0.07 |
| | Cyan coupler (C-4) | 0.14 |
| | Cyan coupler (C-5) | 0.07 |
| | Dye image stabilizer (ST-6) | 0.17 |
| | Polymer (Ply-1) | 0.40 |
| | High boiling organic solvent (solv-4) | 0.23 |
| | Anti-irradiation dye (AI-6) | 0.02 |
| | Anti-irradiation dye (AI-7) | 0.02 |
| Fourth layer (UV absorption layer) | Gelatin | 1.25 |
| | UV absorber (UV-4) | 0.62 |
| | Anti-stain agent (HQ-1) | 0.05 |
| | High boiling organic solvent (solv-3) | 0.24 |
| Third layer (Green-sensitive layer) | Gelatin | 1.42 |
| | Green-sensitive silver chlorobromide emulsion (silver chloride content 98.5%) | 0.13 |
| | Magenta coupler (M-4) | 0.32 |
| | Dye image stabilizer (ST-7) | 0.20 |
| | Dye image stabilizer (ST-8) | 0.02 |
| | Dye image stabilizer (ST-9) | 0.03 |
| | Dye image stabilizer (ST-10) | 0.01 |
| | High boiling organic solvent (solv-2) | 0.65 |
| | Anti-iradiation dye (AI-5) | 0.01 |
| Second layer (Intermediate layer) | Gelatin | 0.79 |
| | Anti-stain agent (HQ-5) | 0.08 |
| | High boiling organic solvent (solv-5) | 0.08 |
| First layer (Blue sensitive layer) | Gelatin | 1.45 |
| | Blue-sensitive silver chlorobromide emulsion (silver chloride content 99.6%) | 0.26 |
| | Yellow coupler (Y-2) | 0.83 |
| | Dye image stabilizer (ST-5) | 0.19 |
| | High boiling organic solvent (solv-1) | 0.35 |
| | Anti-irradiation dye (AI-4) | 0.01 |
| Support | Polyethylene-laminated paper | |

(Preparation of blue-sensitive silver halide emulsion)

After Solution A and Solution B were added in 1000 ml of 2.5 % gelatin aqueous solution kept at 58 ° C., Solution C and Solution D were added simultaneously for 45 minutes. 10 minutes later, Solution E and Solution F were added simultaneously for 15 minutes. In addition, Solution G was added, and 10 minutes after, Solution H and Solution I were added simultaneously for 20 minutes. Then, 5 minutes later, the temperature was lowered and the solution was desalted. By adding water and gelatin, and adjusting pH to 6.2, a mono-dispersed silver chloride emulsion EMP-4 having the average grain size of 0.92 μm, the variation coefficient ($\sigma/r$)=0.10 and silver chloride content of 99.6 % was obtained.

| | |
|---|---|
| Solution A | |
| Sulfuric acid (1N) | 20 cc |
| Solution B | |
| The following silver halide solution (1%) | 2 cc |

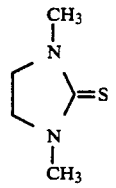

| | |
|---|---|
| Solution C | |
| NaCl | 1.7 g |
| Water to make 140 cc. | |
| Solution D | |
| $AgNO_3$ | 5.0 g |
| Water to make 140 cc. | |
| Solution E | |
| NaCl | 41.4 g |
| Water to make 320 cc. | |
| Solution F | |
| $AgNO_3$ | 119.5 g |
| Water to make 320 cc. | |
| Solution G | |
| BS-3 | $4 \times 10^{-4}$ mol |
| Ethylalcohol | 20 cc |
| Solution H | |
| KBr | 0.35 g |
| $K_2IrCl_6$ | 0.012 g |
| Water to make 50 cc. | |
| Solution I | |
| $AgNO_3$ | 0.5 g |
| Water to make 50 cc. | |

The above-mentioned EMP-4 was subjected to chemical ripening most appropriately at 58° C. using the following compounds. Thus, a blue-sensitive silver halide emulsion (EmB-1) was obtained.

| | |
|---|---|
| Triethyl urea | 1 mg/mol AgX |
| Stabilizer STAB-4 | $3.8 \times 10^{-4}$ mol/mol AgX |
| Sensitizing dye BS-3 | |

(Preparation of green-sensitive silver halide emulsion)

EMP-5 having the average grain size of 0.51 μm, variation coefficient ($\sigma/r$)=0.078 and silver chloride containing rate of 98.5% was obtained int eh same manner as in EMP-4 except that the addition time of Solution C and Solution D was changed and Solution E, Solution F, Solution G, solution H and Solution I were replaced with Solution J, Solution K, Solution L, Solution M and Solution N.

| | |
|---|---|
| Solution J | |
| NaCl | 40.6 g |
| Water to make 320 cc. | |
| Solution K | |
| $AgNO_3$ | 118.1 g |
| Water to make 320 cc. | |
| Solution L | |

-continued

| | |
|---|---|
| GS-2 | $3 \times 10^{-4}$ mol |
| GS-3 | $5 \times 10^{-5}$ mol |
| Ethylalcohol | 20 cc |
| Solution M | |
| KBr | 1.3 g |
| $K_2IrCl_6$ | 0.024 g |
| Water to make 50 cc. | |
| Solution N | |
| $AgNO_3$ | 1.9 g |
| Water to make 50 cc. | |

The above-mentioned EMP-5 was subjected to chemical ripening most appropriately at 58° C.. using the following compounds. Thus, a green-sensitive silver halide emulsion (EmG-1) was obtained.

| | |
|---|---|
| Triethylthiourea | 1 mg/mol AgX |
| Stabilizer STAB-2 | $5.3 \times 10^{-4}$ mol/mol AgX |
| Sensitizing dye GS-2 | |
| Sensitizing dye GS-3 | |

(Preparation of red-sensitive silver halide emulsion)

EMP-6 having the average grain size of 0.60 μm, variation coefficient ($\sigma/r$)=0.072 and silver chloride containing rate of 99.5% was obtained in the same manner as EMP-4 except that the addition time of Solution C and Solution D was changed and Solution E, Solution F, Solution G, Solution H and Solution I were replaced with Solution O, Solution P, Solution Q, Solution R and Solution S.

| | |
|---|---|
| Solution O | |
| NaCl | 41.06 g |
| Water to make 320 cc. | |
| Solution P | |
| $AgNO_3$ | 119.4 g |
| Water to make 320 cc. | |
| Solution Q | |
| RS-2 | $7 \times 10^{-5}$ mol |
| Ethyl alcohol | 20 cc. |
| Solution R | |
| KBr | 0.44 g |
| $K_2IrCl_6$ | 0.10 g |
| Water to make 50 cc. | |
| Solution S | |
| $AgNO_3$ | 0.63 g |
| Water to make 50 cc. | |

The above-mentioned EMP-6 was subjected to chemical ripening most appropriately at 60° C. using the following compounds. Thus, a green-sensitive silver halide emulsion (EmR-1) was obtained.

| | |
|---|---|
| Triethylthio urea | 1 mg/mol AgX |
| Stabilizer STAB-2 | $5.3 \times 10^{-4}$ mol/mol AgX |
| Supersensitizing agent SS-1 | $2.6 \times 10^{-3}$ mol/mol AgX |
| Sensitizing dye RS-2 | |

Y-2

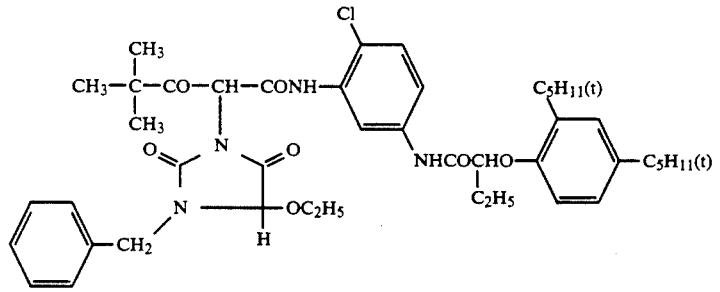

M-4

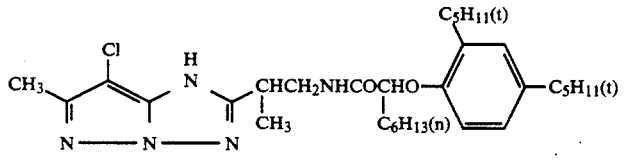

C-1

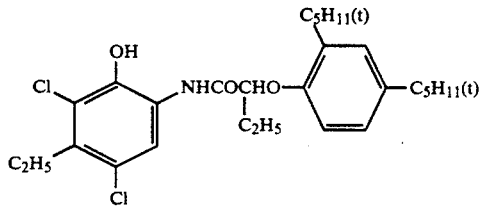

C-3

-continued
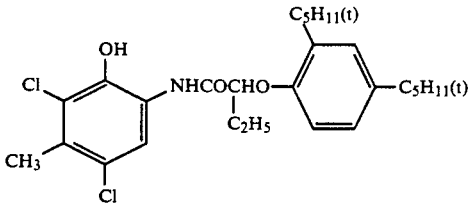
C-4
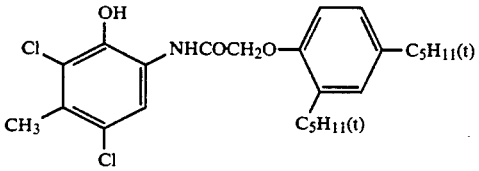
C-5
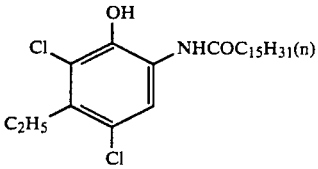
Solvent (solv-1) is a misture of 1:1:2 of
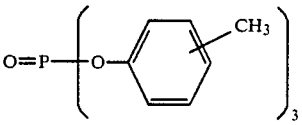
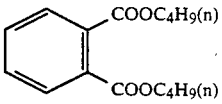
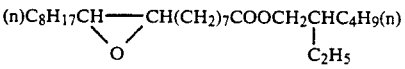
by weight.
Solvent (solv-2) is a mixture of 2:1:1 of
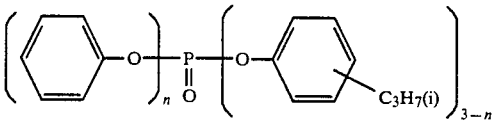
n = 0~3
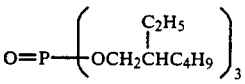
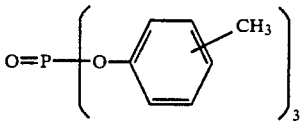
by weight.
Solvent (solv-3) is a mixture of 5:3:1:1 of
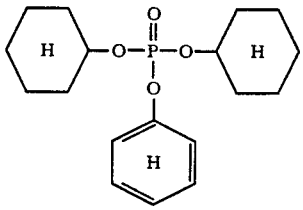

-continued
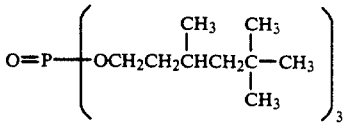
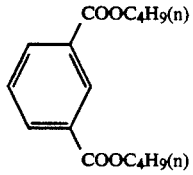
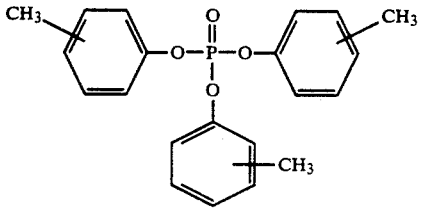
by weight.
UV-4 is a mixture of 2:9:8 of
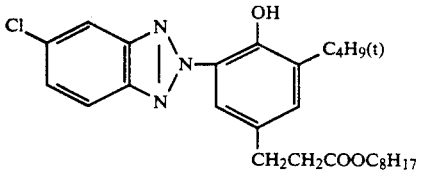
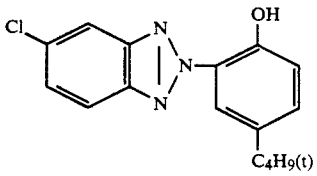
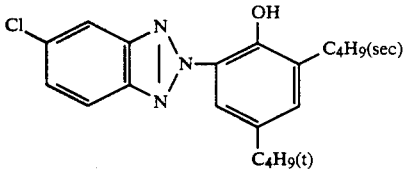
by weight.
Solvent (solv-4) is a mixture of 3:2 of
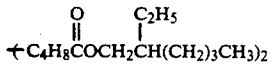
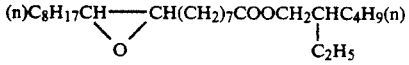
by weight.
Solvent (solv-5)
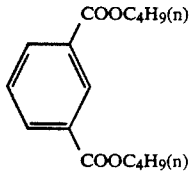
(HQ-1)

-continued
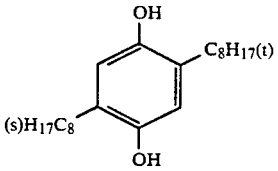
(HQ-5)
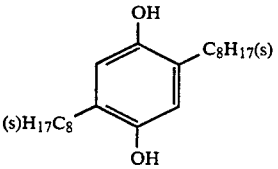
(Ply-1) polymer
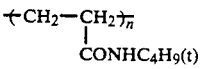
Average molecular weight 80,000
(ST-5)
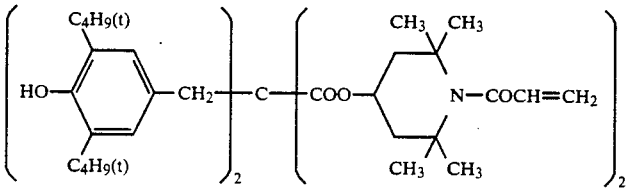
(ST-6) is a mixture of 8:9:5 of
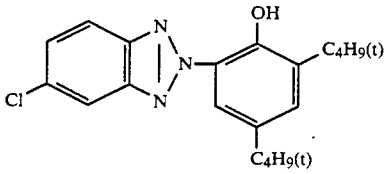
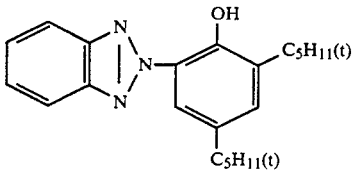
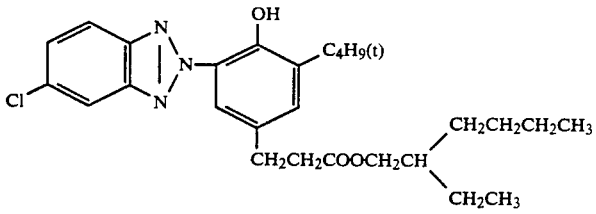
by weight.
(ST-7)
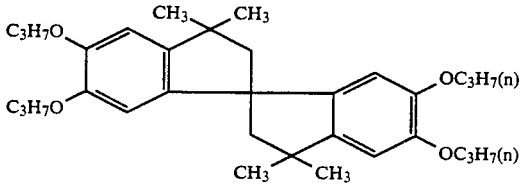
(ST-8)

-continued
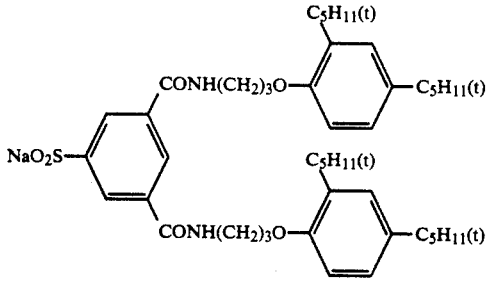
(ST-9)
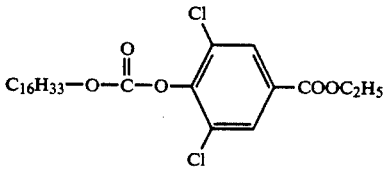
(ST-10)
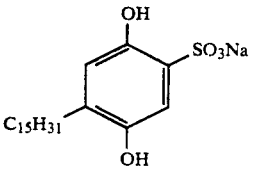
(AI-4)
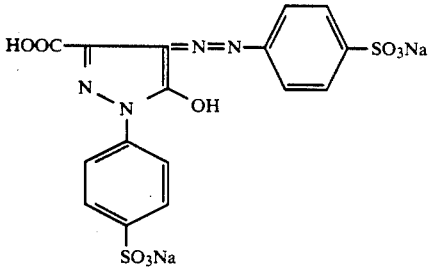
(AI-5)
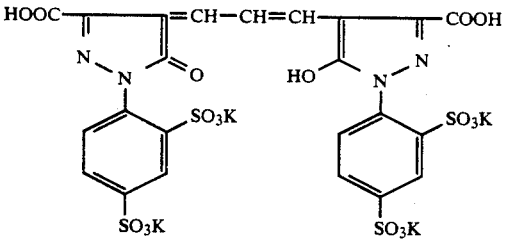
(AI-6)
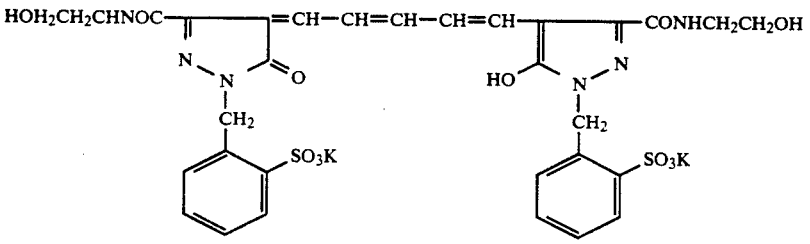
(AI-7)

-continued
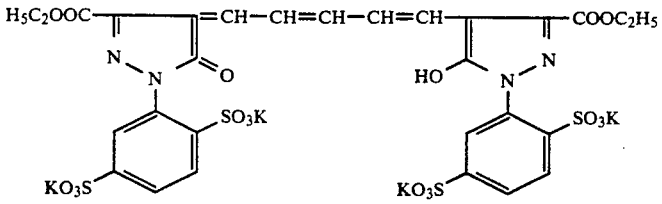
(BS-3)
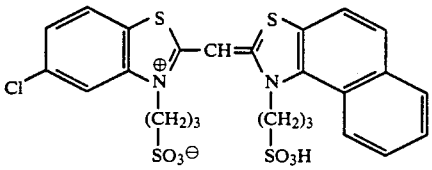
(GS-2)
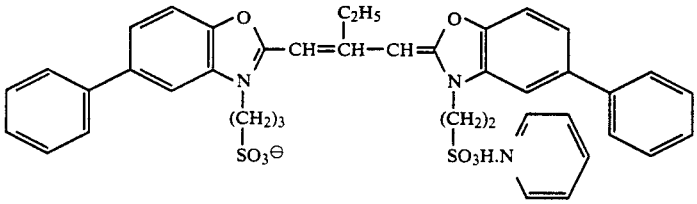
(GS-3)
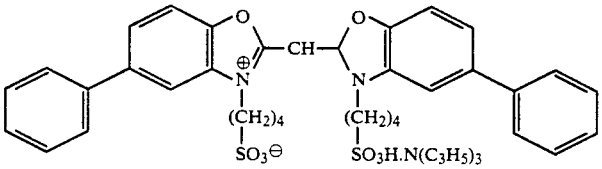
(RS-2)
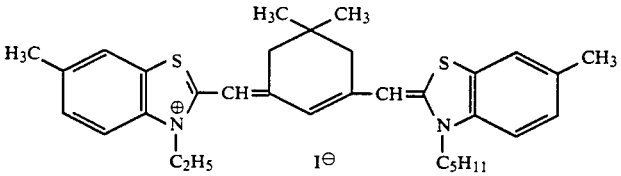
(SS-1)
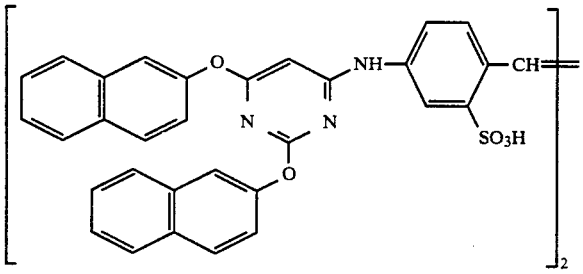
(STAB-4)
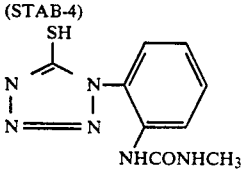

TABLE 2

| Sample No. | White pigment | Sharpness B | Sharpness G | Sharpness R | Quality of layer surface |
|---|---|---|---|---|---|
| 6 | 3.7 g/m$^2$ of TiO | 0.69 | 0.73 | 0.70 | 1.5 |
| 7 | 3.7 g/m$^2$ of TiO | 0.70 | 0.73 | 0.69 | 1.5 |
| 8 | 3.7 g/m$^2$ of TiO and ZnO | 0.70 | 0.74 | 0.70 | 1.5 |
| 9 | 3.7 g/m$^2$ of TiO | 0.69 | 0.73 | 0.70 | 1.5 |
| 10 | 3.7 g/m$^2$ of TiO | 0.72 | 0.74 | 0.70 | 2.0 |

As shown in Table 2, excellent effect can be obtained by combination of light-sensitive materials and processing steps in the invention. A coupler illustrated by formula [M-I] is especially preferable as a magenta coupler.

What is claimed is:

1. A method for forming a dye image which comprises a step of processing, with a color developing solution, a photo-sensitive silver halide photographic material comprising a support having thereon a silver halide emulsion layer, wherein said silver halide emulsion layer comprises silver halide grains having a silver chloride content of not less than 90 mol. %;

said photosensitive silver halide photographic material comprises a white pigment in an amount of not less than 3.5 g per m$^2$ of said photographic material; and said photosensitive silver halide photographic material is, after being processed with the color developing solution, processed with a bleaching solution (BL-1) and subsequently with a fixing solution.

2. A method of claim 1, wherein said silver halide emulsion layer comprises monodispersed silver halide grains of which coefficient of variation is not more than 0.22.

3. A method of claim 1, wherein said white pigment is at least one selected from the group consisting of babarium sulfate, calcium carbonate, calcium silicate, alumina, titanium oxide, zinc oxide, talc.

4. A method of claim 1, wherein said bleaching solution comprises a ferric complex salt of a compound represented by the following formula A or B;

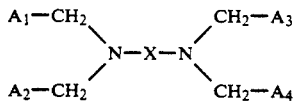

Formula A wherein $A_1$ through $A_4$ are each a —$CH_2OH$ group, a —COOM group or —$PO_3M_1M_2$ group, which may be the same with or different from each other; M, $M_1$ and $M_2$ are each a hydrogen atom, an alkali metal atom or an ammonium group; and X represents a substituted or unsubstituted akylene group having three to six carbon atoms;

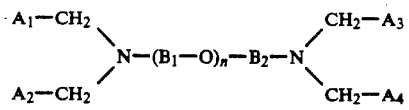

Formula B wherein $A_1$ through $A_4$ are the same as defined in Formula A; n is an integer of 1 to 8; and $B_1$ and $B_2$, which may be the same or different from each other, are a substituted or unsubstituted alkylene group having two to five carbon atoms.

5. A method of claim 4, wherein said ferric complex salt is contained in an amount of not less than 0.1 mol per liter of said bleaching solution.

6. A method of claim 1, wherein said photosensitive silver halide photographic material is processed with said bleaching solution BL-1) for a time of not more than 40 seconds.

7. A method of claim 6, wherein said bleaching solution (BL-1) is replenished at a rate of not more than 50 ml per m$^2$ of said photographic material.

8. A method of claim 7, wherein said bleaching solution (BL-1) is replenished with a part or the whole of a overflowing solution from a bath having a bleaching solution (BL-2) which have been used independently for processing another kind of photosensitive silver halide photographic material.

9. A method of claim 1, wherein said silver halide emulsion layer comprises a magenta dye-forming coupler represented by the following formula [M-1]:

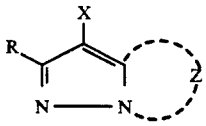

Formula [M-1]

wherein Z represents a group of non-metallic atoms necessary to complete a nitrogen-containing heterocyclic ring which may have a substituent; X represents a hydrogen atom or a group capable of being split off upon reaction with an oxidation product of a color-developing agent; and R represents a hydrogen atom or a substituent.

* * * * *